US008422901B2

(12) United States Patent
Ishii et al.

(10) Patent No.: US 8,422,901 B2
(45) Date of Patent: Apr. 16, 2013

(54) IMAGE FIXING APPARATUS STABLY CONTROLLING A FIXING TEMPERATURE, AND IMAGE FORMING APPARATUS USING THE SAME

(75) Inventors: Kenji Ishii, Kawasaki (JP); Aldyasu Amita, Yokohama (JP); Ken Omura, Machida (JP); Kenichi Hasegawa, Kawasaki (JP); Hiroshi Yokoyama, Yokohama (JP); Satoshi Ueno, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 13/026,945

(22) Filed: Feb. 14, 2011

(65) Prior Publication Data

US 2011/0176822 A1 Jul. 21, 2011

Related U.S. Application Data

(62) Division of application No. 11/184,956, filed on Jul. 20, 2005, now Pat. No. 7,925,177.

(30) Foreign Application Priority Data

| | | |
|---|---|---|
| Jul. 21, 2004 | (JP) | 2004-213244 |
| Sep. 2, 2004 | (JP) | 2004-255114 |
| Sep. 7, 2004 | (JP) | 2004-259590 |
| Sep. 8, 2004 | (JP) | 2004-260717 |
| Sep. 10, 2004 | (JP) | 2004-264165 |

(51) Int. Cl.
*G03G 15/20* (2006.01)

(52) U.S. Cl.
USPC ..... 399/67; 399/69

(58) Field of Classification Search ..... 399/67, 399/69, 328, 334
See application file for complete search history.

(56) References Cited

U.S. PATENT DOCUMENTS 6,263,172 B1 7/2001 Suzuki et al.
6,453,144 B1 9/2002 Sato
(Continued)

FOREIGN PATENT DOCUMENTS

EP 1 582 939 A1 10/2005
JP 63-95484 4/1988
(Continued)

OTHER PUBLICATIONS

U.S. Appl. No. 13/009,199, filed Jan. 19, 2011, Yoshikawa et al.
(Continued)

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes an image forming mechanism and an image fixing unit. The image forming mechanism forms a toner image on a recording sheet. The image fixing unit fixes the toner image onto the recording sheet. The image fixing unit includes a magnetic flux generator, a heat member, a magnetic flux adjuster, and a controlling member. The magnetic flux generator generates a magnetic flux. The heat member is heated inductively by the magnetic flux generated by the magnetic flux generator. The magnetic flux adjuster reduces the magnetic flux active on the heat member to form a heat reduction area in an outer circumferential surface of the heat member in a width direction thereof. The controlling member moves the magnetic flux adjuster to change the heat reduction area.

28 Claims, 19 Drawing Sheets

U.S. PATENT DOCUMENTS

| | | | | |
|---|---|---|---|---|
| 6,901,235 | B2 | 5/2005 | Shimizu et al. | |
| 7,099,616 | B2 | 8/2006 | Kato et al. | |
| 7,570,910 | B2 | 8/2009 | Ishii et al. | |
| 2002/0031380 | A1 | 3/2002 | Sato | |
| 2004/0253027 | A1 * | 12/2004 | Kato et al. | 399/328 |
| 2007/0014601 | A1 | 1/2007 | Yasuda et al. | |

FOREIGN PATENT DOCUMENTS

| | | | | |
|---|---|---|---|---|
| JP | 01011285 | A | * | 1/1989 |
| JP | 4-240683 | | | 8/1992 |
| JP | 06-258978 | | | 9/1994 |
| JP | 09-160416 | | | 6/1997 |
| JP | 10-74009 | | | 3/1998 |
| JP | 2000-066543 | A | | 3/2000 |
| JP | 2001-343860 | | | 12/2001 |
| JP | 2002-83676 | | | 3/2002 |
| JP | 2002-123106 | | | 4/2002 |
| JP | 2002-124371 | | | 4/2002 |
| JP | 2002-148983 | | | 5/2002 |
| JP | 2002-287583 | | | 10/2002 |
| JP | 2002-289336 | | | 10/2002 |
| JP | 2002-328550 | | | 11/2002 |
| JP | 2002-352948 | | | 12/2002 |
| JP | 2002357977 | A | * | 12/2002 |
| JP | 2003-015445 | A | | 1/2003 |
| JP | 2003-123961 | | | 4/2003 |
| JP | 2003-270982 | | | 9/2003 |
| JP | 2003-302847 | | | 10/2003 |
| JP | 2003-302860 | A | | 10/2003 |
| JP | 3487470 | | | 10/2003 |
| JP | 2003-338365 | | | 11/2003 |
| JP | 3495162 | | | 11/2003 |
| JP | 2004/45868 | | | 2/2004 |
| JP | 2004-157513 | | | 6/2004 |
| JP | 2004-272157 | | | 9/2004 |
| JP | 4353419 | | | 8/2009 |
| WO | WO 2004/063819 | | | 7/2004 |
| WO | WO 2004/063819 | A1 | | 7/2004 |
| WO | WO 2004/063820 | | | 7/2004 |
| WO | WO 2005/038533 | A1 | | 4/2005 |

OTHER PUBLICATIONS

Office Action issued Mar. 14, 2011 in Japanese Patent Application No. 2004-255114.

Office Action issued Jul. 17, 2012 in Chinese Application No. 200810177463.X.

* cited by examiner

| COUNT VALUE | | HEAT REDUCTION AREA |
|---|---|---|
| PRINT NUMBER | HEATING TIME (S) | |
| 30 | 45 | NARROWER |
| 50 | 75 | |
| 100 | 150 | |
| 200 | 300 | |
| 300 | 450 | WIDER |

IMAGE FIXING APPARATUS STABLY CONTROLLING A FIXING TEMPERATURE, AND IMAGE FORMING APPARATUS USING THE SAME

CROSS-REFERENCE TO RELATED APPLICATIONS

This application is a divisional of U.S. patent application Ser. No. 11/184,956, filed Jul. 20, 2005 now U.S. Pat. No. 7,925,177, and is based on and claims priority to Japanese patent applications: No. 2004-213244, filed Jul. 21, 2004; No. 2004-255114, filed Sep. 2, 2004; No. 2004-259590, filed Sep. 7, 2004; No. 2004-260717, filed Sep. 8, 2004; and No. 2004-264165, filed Sep. 10, 2004. The entire contents of these applications are herein incorporated by reference.

BACKGROUND OF THE INVENTION

1. Field of the Invention

The present invention relates to an image forming apparatus, and more particularly to an image fixing apparatus which uses an induction heater and is capable of stably controlling a fixing temperature.

2. Discussion of the Background

A background image forming apparatus such as a copy machine, a printer, a facsimile machine, and a multi-function machine capable of copying, printing, and faxing uses an electromagnetic induction type fixing mechanism to reduce a machine rise time for an energy savings.

One example of the electromagnetic induction type fixing mechanism includes a support roller, an auxiliary fixing roller, a fixing belt, a magnetic flux generator, and a pressure roller. The support roller serves as a heat roller, and the auxiliary fixing roller serves as a fixing roller. The fixing belt has a heat resistant property and is extended between the support roller and the auxiliary fixing roller. The magnetic flux generator faces the support roller via the fixing belt. The pressure roller faces the auxiliary fixing roller via the fixing belt. The magnetic flux generator includes a coil including a plurality of wire turns and a core such as an exciting coil core. The coil is wound around the core and is extended in a direction parallel to a surface of a recording sheet in conveyance and perpendicular to a conveyance direction of the recording sheet which is conveyed between the pressure roller and the auxiliary fixing roller.

The fixing belt is heated at a position facing the magnetic flux generator and applies heat to a toner image carried on a recording sheet which is transported to a nip formed between the auxiliary fixing roller and the pressure roller. More specifically, the coil receives an application of a high-frequency alternating current to generate a magnetic field around the coil. The magnetic field induces an eddy current near a surface of the support roller. This causes a generation of Joule heat due to an electrical resistance of the support roller itself.

The above-described electromagnetic induction type fixing mechanism is capable of increasing a fixing temperature of the fixing belt to a desired level in a relatively short time period and with a relatively small amount of energy.

However, the electromagnetic induction type fixing mechanism cannot make sure to suppress a temperature increase at longitudinal end sides of the fixing member, e.g., the fixing belt or roller, which may be overly heated, especially, when the image forming operation is consecutively performed on a narrower-sized recording sheet.

In general, an image forming apparatus is configured to handle various kinds of recording sheets specially in size for image forming: for example, standard A-series size such as A4, or irregular size as well. A recording sheet in A4 size, for example, is in a rectangular form and has a long side and a short side. Therefore, a surface area of the fixing belt facing the recording sheet can be changed by an orientation of image forming, depending on whether the recording sheet needs to be placed in landscape or portrait relative to the fixing belt.

Such a variation of width of the recording sheet causes the fixing belt to have an uneven temperature in the axis direction thereof. That is, during the fixing process, the recording sheet absorbs a certain amount of heat from the surface area of the fixing belt. This results in an uneven surface temperature of the fixing belt. Specifically, a sheet-contact area of the fixing belt which makes contact with the recording sheet has the temperature decreased and a non-sheet-contact areas around both end sides of the fixing belt which do not make contact with the recording sheet have higher temperatures. This problem occurs typically when the image forming is consecutively performed to a relatively small size recording sheet.

If the surface temperature of the fixing belt is adjusted to attempt to increase the lowered temperature of the sheet-contact area of the fixing belt, the lowered temperature of the sheet-contact area of the fixing belt can be adjusted to an appropriate level; however, at the same time, the temperature of the non-sheet-contact area are may exceedingly be increased. If the image forming operation is performed to a relatively large size recording sheet under this condition, a troublesome phenomenon referred to as a hot off-set may be caused at a surface area of the fixing belt where the fixing temperature is too high. That is, because of the exceedingly high temperature, a portion of toner included in the toner image carried on the recording sheet is melt on the recording sheet and is adhered to the fixing belt, not to the recording sheet. As a result, the toner image on the recording sheet loses a portion thereof. If the temperature is partly risen on the surface of the fixing belt in excess of a predetermined range of the fixing temperature, the fixing belt may cause a thermal breakdown.

In contrast, if the surface temperature of the fixing belt is adjusted to attempt to decrease the exceedingly risen temperature of the non-sheet-contact area of the fixing belt, the exceedingly risen temperature of the non-sheet-contact area of the fixing belt can be adjusted to an appropriate level; however, at the same time, the temperature of the sheet-contact area may exceedingly be decreased. If the image forming operation is performed under this condition, another troublesome phenomenon referred to as a cold off-set may be caused at a surface area of the fixing belt where the fixing temperature is too low. That is, because of the exceedingly low temperature, a portion of toner included in the toner image carried on the recording sheet is not melt on the recording sheet and is adhered to the fixing belt, not to the recording sheet. As a result, the toner image on the recording sheet loses a portion thereof.

One example technique attempts to solve the above-described problems by suppressing an increase of the fixing temperature at the non-sheet-contact area of the fixing roller. This technique provides a magnetic flux shield for shielding a part of the magnetic flux generated by the magnetic flux generator (e.g., an induction coil) disposed inside the fixing roller. More specifically, the magnetic flux generator is configured to change its position in accordance with a sheet-contact area of the fixing roller to change a range of area to shield accordingly so as to shield the magnetic flux applied to the fixing roller at the non-sheet-contact area of the fixing roller. Thereby, a temperature rise at the non-sheet-contact area of the fixing roller is suppressed.

SUMMARY OF THE INVENTION

This patent specification describes a novel image forming apparatus includes an image forming mechanism and an image fixing unit. The image forming mechanism is configured to form a toner image on a recording sheet. The image fixing unit is configured to fix the toner image onto the recording sheet. The image fixing unit includes a magnetic flux generator, a heat member, a magnetic flux adjuster, and a controlling member. The magnetic flux generator is configured to generate a magnetic flux. The heat member is configured to be heated inductively by the magnetic flux generated by the magnetic flux generator. The magnetic flux adjuster is configured to reduce the magnetic flux active on the heat member to form a heat reduction area in an outer circumferential surface of the heat member in a width direction thereof. The controlling member is configured to move the magnetic flux adjuster to change the heat reduction area.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
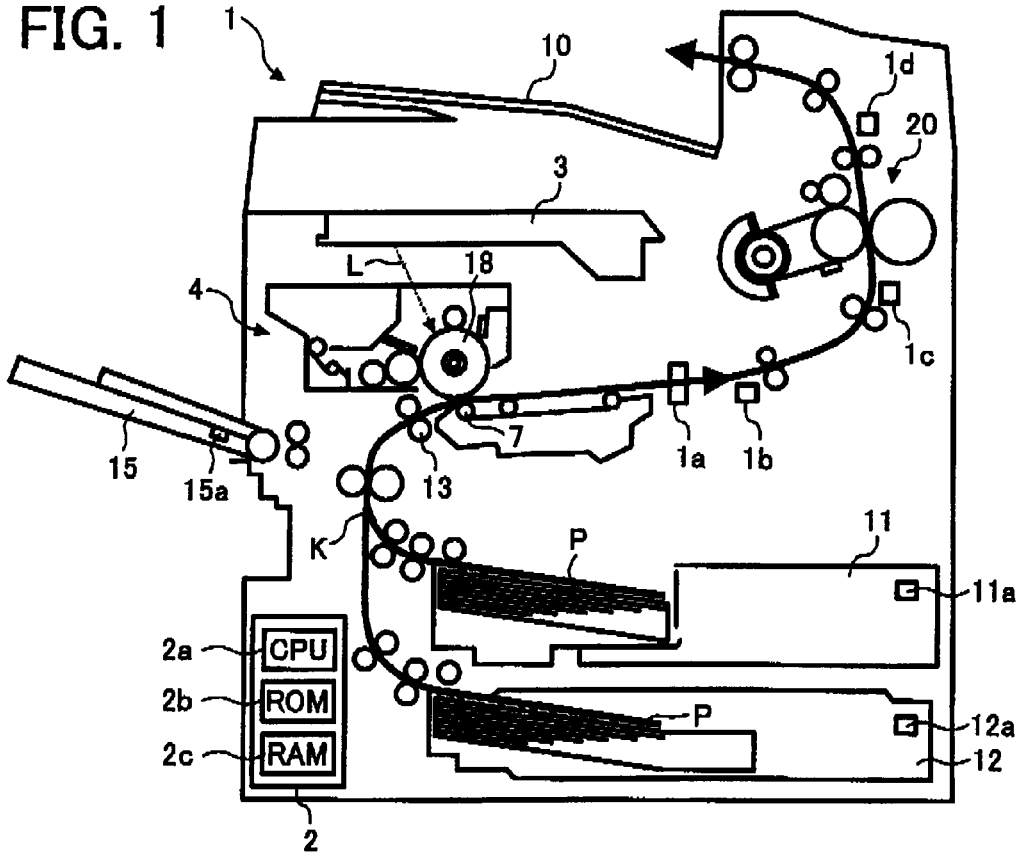
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1 according to an embodiment of the present invention is explained. The image forming apparatus 1 illustrated in FIG. 1 is a laser printer as one example of the embodiment of the present invention. As shown in FIG. 1, the image forming apparatus 1 includes a control circuit unit 2, an exposure unit 3, a process cartridge 4, an image transfer unit 7, an output tray 10, sheet cassettes 11 and 12, a registration roller 13, a manual input tray 15, and an image fixing unit 20.

The control circuit unit 2 includes a CPU (central processing unit) 2*a*, a ROM (read only memory) 2*b*, and a RAM (random access memory) 2*c*. The process cartridge 4 includes a photosensitive drum 18. The sheet cassettes 11 and 12 include sheet size detectors 11*a* and 12*a*, respectively. The manual input tray 15 includes a sheet size detector 15*a*.

The control circuit unit 2 controls the entire operations of the image forming apparatus 1. Specifically, the CPU 2*a* controls the entire operations of the image forming apparatus 1 in accordance with programs including an image forming program stored in the ROM 2*b* by utilizing memories and counters formed in the RAM 2*c*. The memories and counters are configured to store various kinds of information including temperature values, count values, recording sheet sizes, a print number in a print job, and so forth.

The exposure unit 3 irradiates an exposure light beam L modulated according to image information to a surface of the photosensitive drum 18. The process cartridge 4 serves as an image forming engine and is configured to be a single exchangeable unit. The photosensitive drum 18 is configured to rotate anticlockwise in the drawing. The image transfer unit 7 configured to transfer a toner image formed on the surface of the photosensitive drum 18 onto a recording sheet P. The output tray 10 is configured to receive and store the recording sheets P after the image forming operations. Each of the sheet cassettes 11 and 12 is configured to store a plurality of recording sheets P. The sheet size detector 11*a* of the sheet cassette 11 is configured to detect a sheet size of the recording sheet stored in the sheet cassette 11, and the sheet size detector 12*a* of the sheet cassette 12 is configured to detect a sheet size of the recording sheet stored in the sheet cassette 12. The registration roller 13 is configured to configured to transport the recording sheet P to the image transfer unit 7. The manual input tray 15 is configured to insert manually a recording sheet. The sheet size detector 15*a* of the manual input tray 15 is configured to detect a sheet size of the recording sheet stored in the manual input tray 15. The image fixing unit 20 is configured to fix a not-fixed toner image formed on the recording sheet P.

Each of the sheet size detectors 11*a*, 12*a*, and 15*a* includes a photosensor configured to detect a position of sheet fence (not shown). The sheet fence is provided inside each of the sheet cassettes 11 and 12 and the manual input tray 15 and is configured to support the stored recording sheet P horizontally in the width direction of the recording sheet P.

In FIG. 1, a reference 1*a* is a sheet thickness detector configured to detect a thickness of the recording sheet P. Reference 1*b* and 1*c* are a transfer speed detector configured to detect a transfer speed of the recording sheet P. Reference 1*d* is an environment detector configured to detect environment conditions such as an environment temperature, humid, etc., around the image forming apparatus 1. The sheet thickness detector 1*a* may be used as a sheet kind detector configured to detect a sheet kind of the recording sheet P.

With reference to FIG. 1, example operations of the image forming apparatus 1 are explained. The exposure unit 3 starts to irradiate the exposure light beam L modulated according to image information to the surface of the photosensitive drum 18 of the process cartridge 4. The photosensitive drum 18 is rotated in an anticlockwise direction and is subjected to an electrophotographic image forming process including charging, exposing, developing processes, and so forth, thereby forming a toner image on the surface thereof. During this image forming process, the recording sheet P is transported towards the image transfer unit 7 by the registration roller 13. Then, the toner image formed on the surface of the photosensitive drum 18 and the recording sheet P being moved in synchronism with each other meet at the image transfer unit 7. Thereby, the toner image is transferred onto the recording sheet P by the image transfer unit 7.

Apart from the above-described operations, to start the image forming process, one of the sheet cassettes 11 and 12 and the manual input tray 15 is selected automatically or manually. The sheet cassettes 11 and 12 are typically used to store the recording sheets P of different size or of same size but in different orientation, and the manual input tray 15 is typically used in occasions using a special recording sheet such as an OHP (overhead projector) sheet, for example.

In this discussion, it is assumed that the sheet cassette 11 is selected. An uppermost sheet of the plurality of recording sheets P stored in the sheet cassette 11 is transported towards a transportation passage K. The recording sheet P transported is subsequently transferred to the position of the registration roller 13 through the transportation passage K. The registration roller 13 once stops the recording sheet P and restarts to transfer the recording sheet P in synchronism with the movement of the photosensitive drum 18 so that the toner image and the recording sheet accurately meet at a transfer position of the image transfer unit 7.

After passing through the image transfer unit 7, the recording sheet P is further transferred towards the image fixing unit 20 through the transportation passage K. Then, the recording sheet P is caused to enter the image fixing unit 20 in which the recording sheet P is pressed and heated between a fixing belt and a pressure roller which are included in the image fixing unit 20. Thus, the toner image on the recording sheet P is melt and fixed in the image fixing unit 20. The recording sheet P having the fixed toner image thereon is driven off from the image fixing unit 20 and is ejected onto the output tray 10 from the image forming apparatus 1. In this way, the series of the image forming operation is executed.

Figure 2:
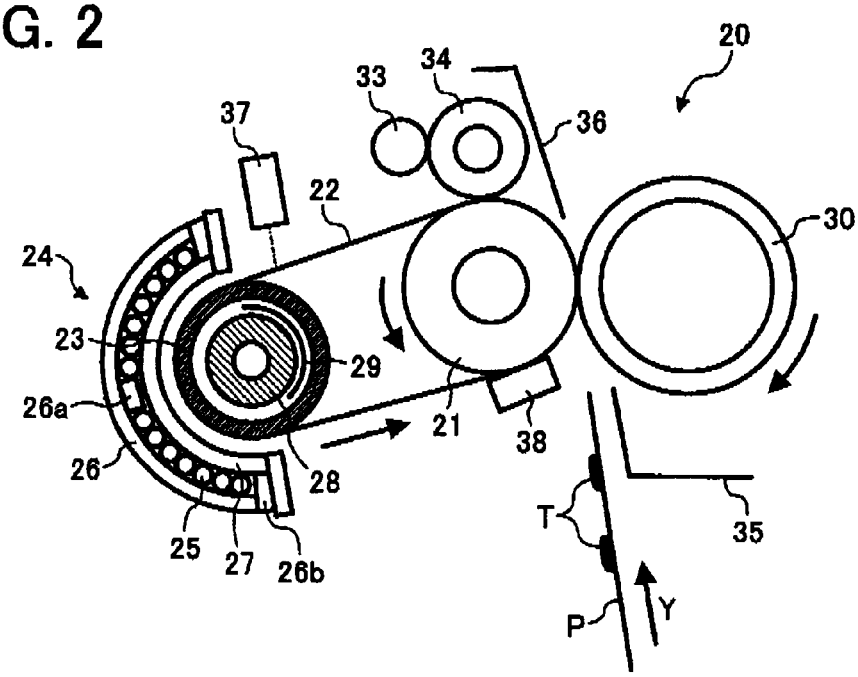
FIG. 2 is a schematic diagram of an image fixing unit of the image forming apparatus shown in FIG. 1.

With reference to FIG. 2, an example structure and operation of the image fixing unit 20 is explained. As illustrated in FIG. 2, the image fixing unit 20 includes an auxiliary fixing roller 21, a fixing belt 22, a support roller 23, an induction heater 24, a pressure roller 30, a cleaning roller 33, an oil-coated roller 34, a guide plate 35, a separation plate 36, a thermopile 37, a thermistor 38, and a thermostat 39.

The auxiliary fixing roller 21 includes a surface layer which is an elastic layer including a silicone rubber or the like and is configured to be driven by a driving unit (not shown) to rotate in an anticlockwise direction in the drawing.

The support roller 23 may be referred to as a heat roller. This support roller 23 includes a non-magnetic material such as a stainless steel (e.g., SUS304), for example, and is configured to have a cylindrical shape driven to rotate in an anticlockwise direction in the drawing. As illustrated in FIG. 2, the support roller 23 internally includes an internal core 28 and a magnetic flux shield plate 29, both of which are held for rotation in the support roller 23. The internal core 28 includes a ferromagnetic material such as a ferrite, for example. The magnetic flux shield plate 29 covers a part of the surface of the internal core 28. The internal core 28 adjacently faces the induction heater 24 via the fixing belt 22 and the support roller 23. Driving mechanism for the support roller 23 and for the internal core 28 and the magnetic flux shield plate 29 are separately provided.

As illustrated in FIG. 2, the fixing belt 22 is held and extended between the auxiliary fixing roller 21 and the support roller 23. This fixing belt 22 is configured to be an endless belt of a multi-layered structure including a base material, a heat layer, an elastic layer, and a release layer.

The base material of the fixing belt 22 includes a heat-resisting resin material such as a polyimide resin, a polyamide-imide resin, a PEEK (polyether ether ketone) resin, a PES (polyether sulfone) resin, a PPS (polyphenylene sulfide) resin, a fluorocarbon resin and the like. The heat layer includes any one of materials such as nickel, stainless steel, iron, copper, cobalt, chrome, aluminum, gold, platinum, silver, tin, and palladium, or an alloy of at least two metals from among these metals. The elastic layer includes any one of materials such as a silicone rubber, a fluoro-silicone rubber, or the like. The release layer includes any one of fluorocarbon resins such as a PTFE (polytetrafluoroethylene) resin, a polytetrafluoroethylene perfluoroalkyl vinyl ether copolymer, i.e., a FEP (fluorinated ethylene propylene resin), or an amalgamation of these resins.

In this example of the fixing belt 22, the base material and the heat layer together form a composite layer, that is, three of the heat layer are formed with space in the base material. On such a composite layer, the elastic layer and the release layer are formed in this order.

As illustrated in FIG. 2, the induction heater 24 includes a coil 25, a core 26, and a coil guide 27. The coil guide 27 has a curbed shape in accordance with a round portion of the fixing belt 22 supported by the support roller 23. The coil 25 includes a litz wire formed by binding a plurality of thin wires. This litz wire is wound and is extended along the coil guide 27 and in a direction perpendicular to the surface of the drawing so as to cover an external circumferential surface of the fixing belt 22 supported by the support roller 23. The coil guide 27 includes a resin material having a relatively high heat-resisting property, and is configured to hold the coil 25. This coil guide 27 also serves as a frame of the induction heater 24. The core 26 includes a ferromagnetic material such as a ferrite having a relative permeability of about 2500 and is provided with a center core 26*a* and a side core 26*b*. The core 26 has a cubed shape in accordance with the coil guide 27 and is disposed in a way so as to closely face the coil 25. The center core 26*a* is disposed at an approximately circumferential-middle position of the coil 25 where a density of magnetic flux generated around and by the coil 25 reaches its peak value. The coil 25 is connected to a high-frequency power source (not shown) and receives an application of an alternating current having a frequency in the range of from approximately 10 kHz to approximately 1 MHz from the high-frequency power source.

The pressure roller 30 includes a cylindrical member which includes an aluminum, a copper, or a stainless steel. The cylindrical member is coated with an elastic layer including a fluorocarbon rubber, a silicone rubber, or the like. Such elastic layer of the pressure roller 30 has a thickness of from approximately 1 mm to approximately 5 mm and an Asker hardness of from approximately 20 degrees to approximately 50 degrees. The pressure roller 30 contacts the fixing belt 22 supported by the auxiliary fixing roller 21 with an application of a pressure to the fixing belt 22 so that a fixing nip area is formed between the pressure roller 30 and the fixing belt 22. The fixing nip area is an area into which the recording sheet P is transported in a direction Y to receive the image fixing operation.

The guide plate 35 is disposed around an entrance of the fixing nip area and is configured to guide the recording sheet P towards the fixing nip area. The separation plate 36 is disposed around an exit of the fixing nip area and is configured to guide the recording sheet P and also to help separation of the recording sheet P from the fixing belt 22.

The oil coating roller 34 is arranged in contact with the fixing belt 22 which applies oil such as a silicone oil to a surface of the fixing belt 22. With such an application of oil to the fixing belt 22, releasing a toner image T from the fixing belt 22 can be made with reliability.

The cleaning roller 33 contacts the oil coating roller 34 to remove contamination from the surface of the oil coating roller 34.

The thermopile 37 is a non-contact type temperature detector and is disposed at a position to face an approximately middle portion of the fixing belt 22 widthwise. This position is out of an area for adjustment of the fixing belt 22, which is explained afterwards.

The thermistor 38 is a contact type temperature detector and is disposed at a position to contact a circumferential edge surface of the fixing belt 22. This position is within the area for the adjustment of the fixing belt 22.

The above-explained thermopile 37 and the thermistor 38 detect surface temperatures of the fixing belt 22, that is, the fixing temperature of the fixing belt 22. Based on the detected fixing temperature, the induction heater 24 which includes an inverter power source circuit which is a high-frequency power source adjusts its output using this inverter power source circuit. Thus, the fixing temperature on the surface of the fixing belt 22 is held at a constant level. In addition, based on the detected temperatures by the thermopile 37 and the thermistor 38, the magnetic flux acting around lateral edges of the support roller 23 is adjusted, which is explained afterwards.

The thus-structured image fixing unit 20 performs the fixing operation in a way as described below. As illustrated in FIG. 2, when the auxiliary fixing roller 21 is driven to rotate, the fixing belt 22 is driven to rotate in a direction indicated by an arrow, the support roller 23 rotates anticlockwise, and the pressure roller 30 rotates in a direction indicated by an arrow. The fixing belt 22 is heated at a position facing the induction heater 24. More specifically, the induction heater 24 is configured to alternately switch directions of generate magnetic lines of force between the core 26 and the core 28 by an application of an alternating current with a high frequency to the coil 25. At this moment, an eddy current is generated in a surface of the support roller 23 and in the heat layer of the fixing belt 22. Consequently, a Joule heat is generated due to electrical resistances of the support roller 23 and the heat layer of the fixing belt 22. Accordingly, the fixing belt 22 is heated by heat of the heat layer thereof and by heat from the support roller 23. As such, the support roller 23 serves as a heating member and the fixing belt 22 serves as a heating member on one hand and also a member to be heated on the other hand.

The surface of the fixing belt 22 heated by the induction heater 24 is then caused to pass by the thermistor 38 and to reach a position to contact the pressure roller 30 so as to heat the toner image T held on the recording sheet P transported thereto.

More specifically, the recording sheet P carrying the toner image T through the above-described image forming process is guided in the direction Y by the guide plate 35 and is caused to enter the fixing nip area formed between the fixing belt 22 and the pressure roller 30. Accordingly, the toner image T is fixed on the recording sheet P by heat from the fixing belt 22 and by pressure from the pressure roller 30, and the recording sheet P having the fixed toner image T is ejected from the fixing nip area between the fixing belt 22 and the pressure roller 30.

After passing by the pressure roller 30, the heated surface of the fixing belt 22 is then caused to pass sequential by the oil coating roller 34 and the thermopile 37 and returns to the position where it is initially heated.

The fixing process in the image forming operation is executed by continuously repeating such series of operations as described above.

Figure 3:
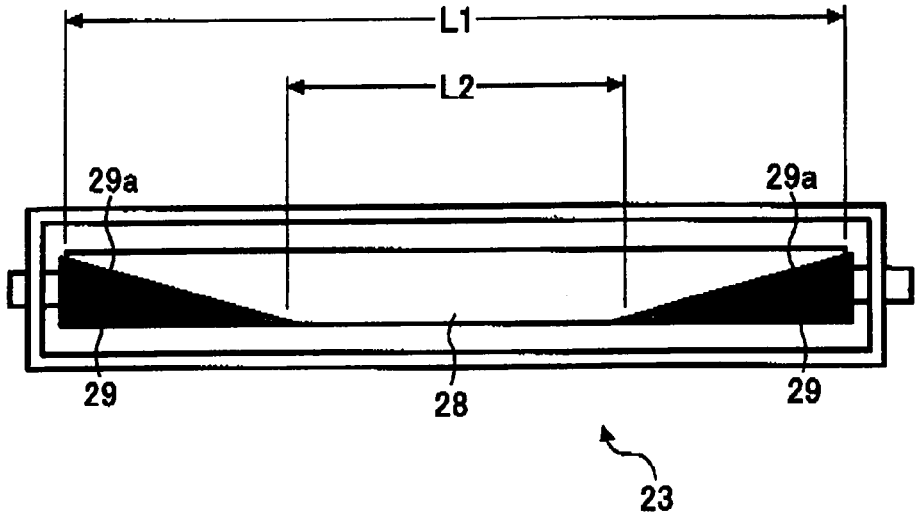
FIG. 3 is a schematic diagram of an interior of a support roller shown in FIG. 2.

With reference to FIG. 3, an example structure and operations of the support roller 23 are explained. FIG. 3 illustrates the support roller 23 in cross section seen from the induction heater 24. As illustrated in FIG. 3, the internal core 28 and the magnetic flux shield plate 29 are arranged for rotation inside the support roller 23.

The internal core 28 in cylindrical shape and of ferromagnet has lateral edge sides covered by the magnetic flux shield plate 29 of diamagnet such as a copper or the like. The magnetic flux shield plate 29 includes a slant side 29*a* at each of lateral edge sides thereof. With the slant side 29*a*, an area for shutting a circumferential surface of the internal core 28 is gradually decreased or increased from an edge of the internal core 28. Thereby, it becomes possible to vary a magnetic flux shield area formed in a lateral direction of the internal core 28, which faces the coil 25 of the induction heater 24, by driving the internal core 28 and the magnetic flux shield plate 29 to rotate.

Figure 4:
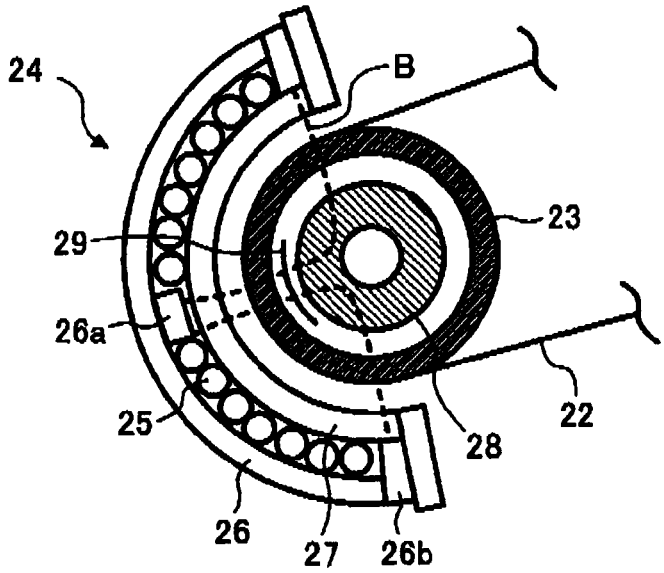
FIG. 4 is a cross-sectional view of an induction heater in relation to a fixing belt and a support roller.
Figure 5:
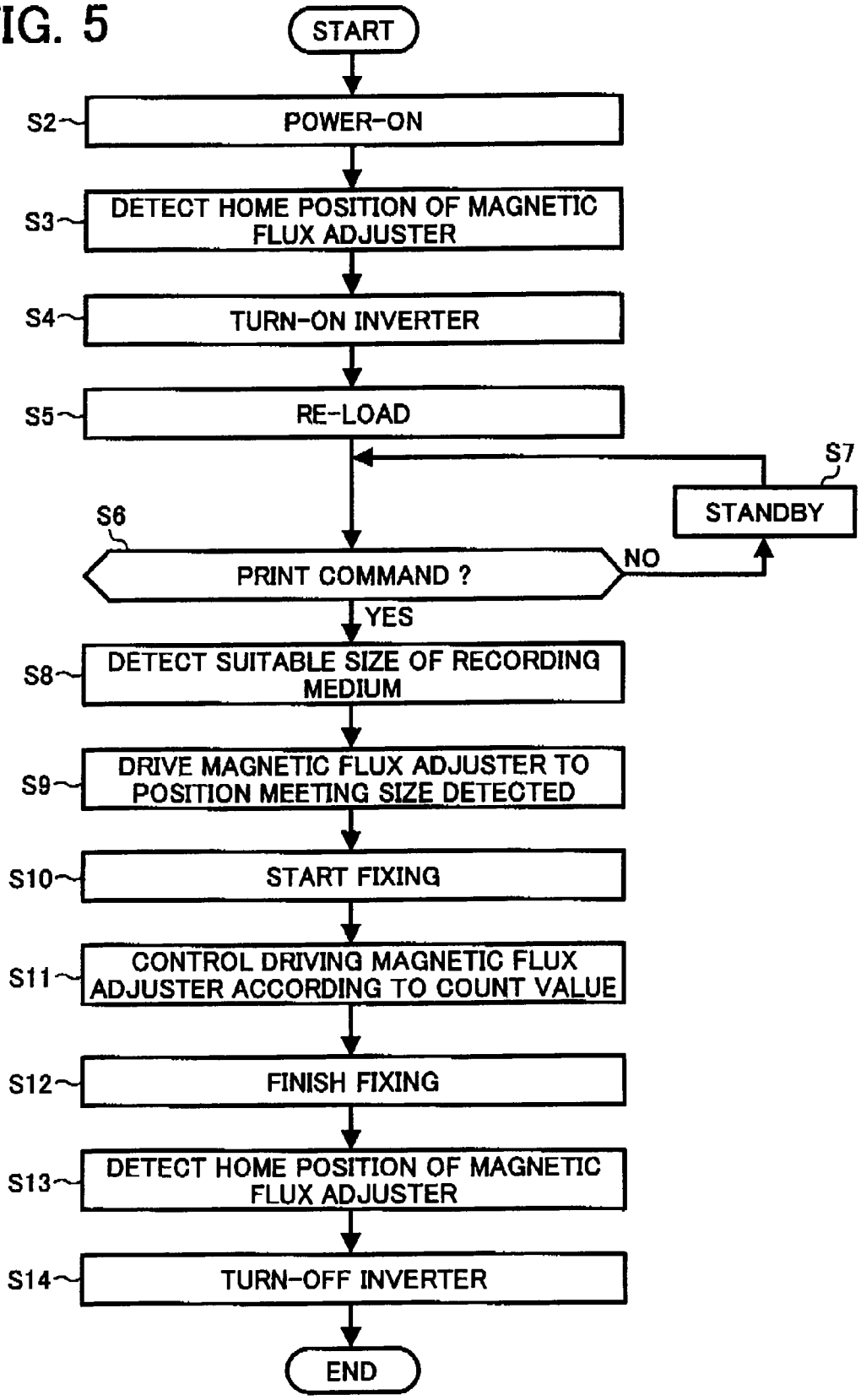
FIG. 5 is a flowchart of an example procedure of a heat-reduction-area control operation for the image fixing unit of FIG. 2.

More specifically, with reference to FIG. 4, a normal peak magnetic flux is generated along dashed-imaginary-lines in FIG. 4 when the magnetic flux shield plate 29 does not intervene the magnetic flux between the center core 26*a* of the core 26 and the internal core 28. However, when the magnetic flux shield plate 29 intervenes, such a normal peak magnetic flux is accordingly reduced. Thus, a heating efficiency is reduced in a surface area of the support roller 23 intervened by the magnetic flux shield plate 29 as the magnetic flux reduces. The surface area of the support roller 23 in which the heating efficiency is varied in response to the change of the magnetic flux shield area is referred to a heat reduction area.

The heat reduction area formed in the lateral direction of the support roller 23 by the intervention of the magnetic flux shield plate 29 can be adjusted by changing an attitude of the magnetic flux shield plate 29 relative to the core 25. More specifically, the heat reduction can be made at the both sides of the support roller 23 within a length range of from 0 to (L1−L2)/2 by turning the magnetic flux shield plate 29 together with the internal core 28, as illustrated in FIG. 3. In this way, the magnetic flux shield plate 29 functions as a magnetic flux adjusting member to vary the magnetic flux shield area for the magnetic flux acting on the support roller 23 or the fixing belt 22 in the width direction, which ultimately changes the heat reduction area of the support roller 23 or the fixing belt 22.

The internal core 28 and the magnetic flux shield plate 29 are driven with a driving mechanism (not shown) such as a stepping motor connected to a shaft of the internal core 28. This driving mechanism may be independent from a driving mechanism for driving the auxiliary fixing roller 21, the fixing belt 22, and the support roller 23.

To be more specific, the internal core 28 and the magnetic flux shield plate 29 are turned by a specific angle along in a circumferential direction of the support roller 23 so that the greatest area of the magnetic flux shield plate 29 faces the center core 26*a*. At this time, the heat reduction area is adjusted to its maximum and, as a result, an area of L2 which is out of the heat reduction area is a main heating area of the fixing belt 22. This condition may be suitable for the image forming operation handling the recording sheet P with a lateral size of L2.

When the internal core 28 and the magnetic flux shield plate 29 are further turned by another specific angle along in the circumferential direction of the support roller 23 so that the greatest area of the magnetic flux shield plate 29 does not face the center core 26*a*. At this time, the heat reduction area is adjusted to its minimum, that is, zero and, as a result, an entire area of L1 is a main heating area of the fixing belt 22.

The thus-structured image fixing unit 20 is capable of performing the image forming operations consecutively with a plurality of recording sheets P by turning the attitude of the magnetic flux shield plate 29 to change the heat reduction area.

Referring to FIGS. 5-8, an example procedure of an heat-reduction-area control operation for the image fixing unit 20 is explained. In a flowchart of FIG. 5, when the image forming apparatus 1 is energized in Step S2, a home position search is performed for the magnetic flux shield plate 29 in Step S3. That is, the magnetic flux shield plate 29 is driven to turn to its home position. FIG. 6A demonstrates a condition in that the magnetic flux shield plate 29 is at its home position where the magnetic flux shield plate 29 does not intervene and no heat reduction area is formed. In FIG. 6A, M represents a heating area, B5T represents the recording sheet P of B5 size in a landscape orientation, that is, the short side of the recording sheet P being set perpendicular to the transportation direction of the recording sheet P. Accordingly, under the condition of FIG. 6A, the magnetic flux is fully activated across an entire width of the heating area M.

Then, in Step S4, the inverter power source circuit of the image fixing unit 20 is energized so that the induction heater 24 is caused to start heating. Then, after reloading the power to the image fixing unit 20 in Step S5, a determination is performed in Step S6 as to whether the image forming operation is commanded.

When the image forming operation is determined as not being commanded in Step S6, the determination is repeated via a predetermined standby time period in Step S7.

Figure 6A:
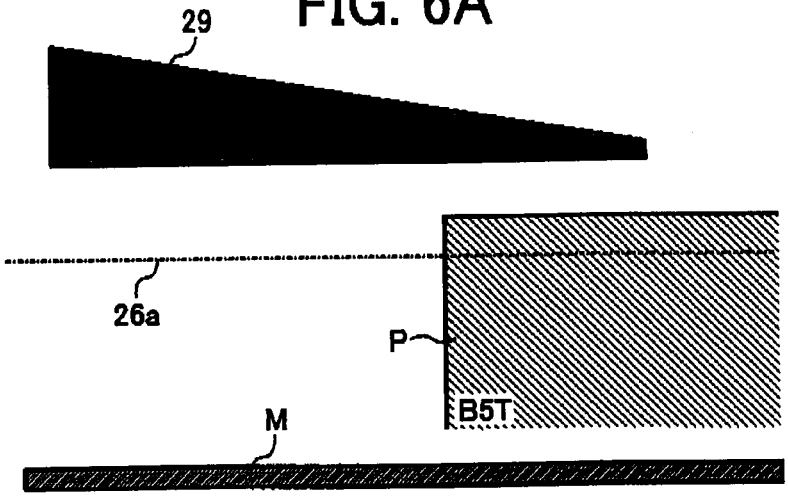
FIGS. 6A-6C are schematic diagrams for explaining relationships of a magnetic flux shield plate, a heating area, a heat reduction area, a center core, and a recording sheet in a width direction of the support roller.
Figure 6B:
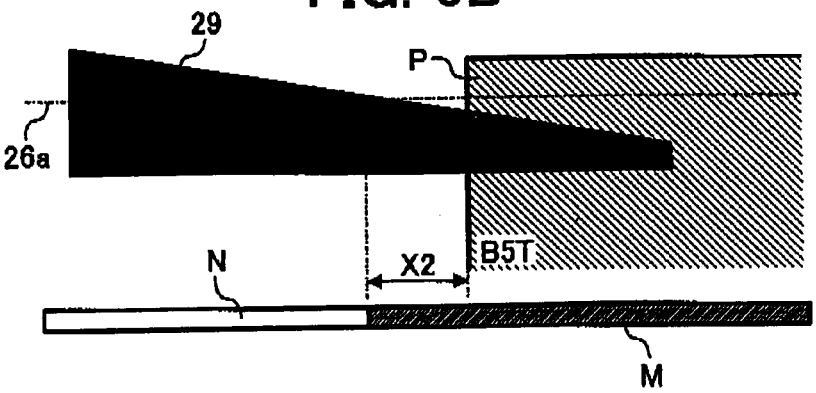
Figure 6C:
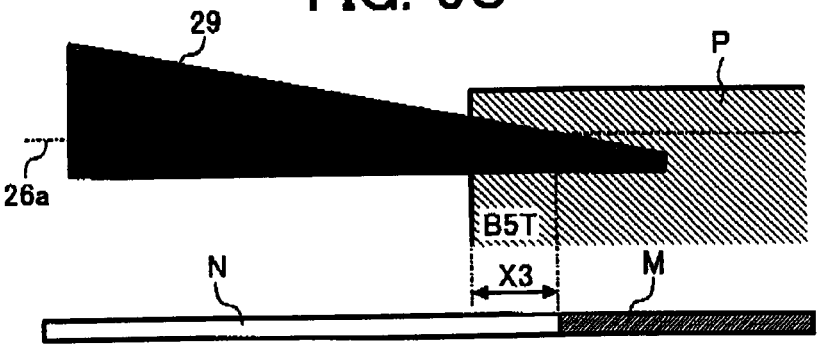

When the image forming operation is determined as being commanded in Step S6, the image forming apparatus 1 selects a recording sheet P from among the sheet cassettes 11 and 12 and the manual input tray 15, in Step S8. In this process, the recording sheet P in a suitable size for the commanded image forming operation is detected by the sheet size detector 11*a*, 12*a*, or 15*a*, for example. According to this selection of the recording sheet P in suitable size for the image forming operation, a non-sheet-passing area is defined in the surfaces of the support roller 23 and the fixing belt 22, at which the temperature may excessively be increased. The selection of the recording sheet P may also be executed based on any input command entered by an operator. In this example operation, the size of the recording sheet P selected is B5 which is stored in the sheet cassette 11, for example, and which is relatively small and has a relatively small width in parallel to the width of the support roller 23, as illustrated in FIGS. 6A-6C.

Then, in Step S9, the magnetic flux shield plate 29 is caused to turn in accordance with the size information of the recording sheet P selected. In this case, as illustrated in FIG. 6B, a heat reduction area N is grown to an extent within the non-sheet-passing area and the heating area M is narrowed instead. More specifically, the heating area M has a coverage wider than the recording sheet P by a degree of X2, as illustrated in FIG. 6B. This arrangement is made because the temperatures at the non-sheet-passing areas of the support roller 23 and the fixing belt 22 may not increase immediately after the heating operation and because a temperature around the boarder between the non-sheet-passing area and a sheet-passing area may excessively be reduced if the magnetic flux is reduced across the entire width of the non-sheet-passing area.

Then, in Step S10, the fixing process is started in a consecutive manner for the plurality of the recording sheet P. At this time, a heating time and an image forming number are counted with counters formed in the RAM 2*c* of the image forming apparatus 1. The heating time is an accumulated time that the high-frequency power source applies power to the induction heater 24. The image forming number is an accumulated number of printed sheets through the image forming operations.

Then, in Step S11, the position of the magnetic flux shield plate 29 is adjusted so as to grow the heat reduction area N and instead to shorten the heating area M at an occurrence of one of events that the heating time reaches a predetermined count value counted by one of the counters and the image forming number reaches another predetermined count value counted by another one of the counters.

Specifically, the magnetic flux shield plate 29 initially set at the position indicated in FIG. 6B is controlled so that the heat reduction area N is stepwise widen according to an increase of the count value. Upon an excess of the predetermined count value, the heat reduction area N is wider than the non-sheet-passing area and the heating area M is shorter than the sheet-passing area. As illustrated in FIG. 6C, the heat reduction area N is wider than the non-sheet-passing area by an extent of X3.

Figures 7, 8:
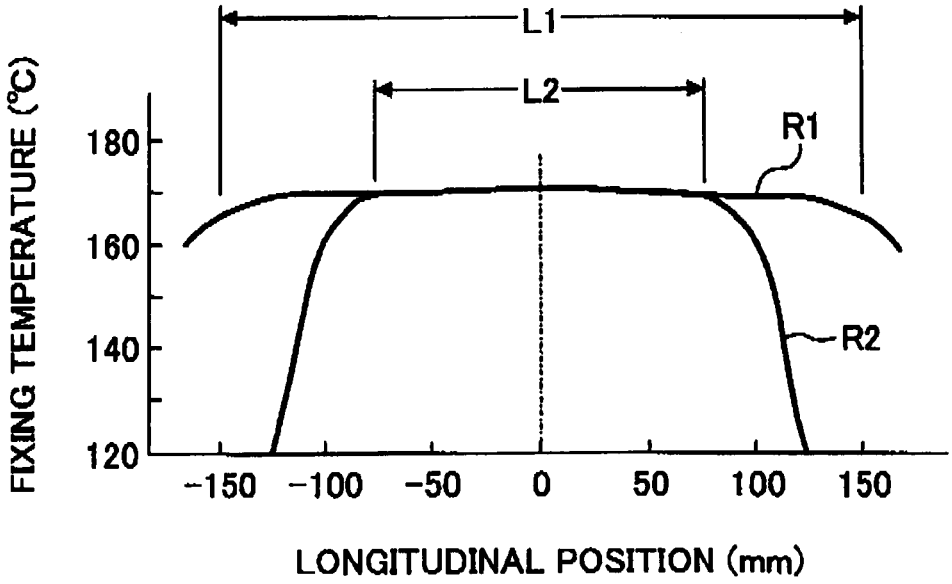
FIG. 7 is a cross reference table representing a relationship between a print number and the heat reduction area and between a heating time and the heat reduction area.
FIG. 8 is a graph showing a relationship between a width position in a fixing surface of a fixing belt and a fixing temperature.

The relationship between the count values and the heat reduction area N is summarized into a cross reference table, as shown in FIG. 7, which is stored in the image forming apparatus 1. As shown in the cross reference table of FIG. 7, the magnetic flux shield plate 29 is controlled with an increase of the image forming number or the heating time so that the heat reduction area N is stepwise grown wider.

The above-described arrangement of FIG. 7 is made because transmission of heat gradually occurs from the heating area M to the heat reduction area N which is not directly heated as the heating time and the image forming number increase after the consecutive image forming operations begin. If the heat reduction area N is fixed during the consecutive image forming operations, an overheated area may be generated in the heat reduction area N and close to the heating area M.

In this example, as described above, the magnetic flux shield plate 29 is controlled with an increase of the image forming number or the heating time so that the heat reduction area N is stepwise grown wider. Therefore, the heat reduction area N is protected from generating an overheated area due to a transmission of heat from the heating area M.

After a completion of the consecutive image forming operations in Step S12, the magnetic flux shield plate 29 is returned to its home position in Step S13. Then, in Step S14, the inverter power source circuit is turned off so that the induction heater 24 is caused to stop heating. Then, the process ends.

FIG. 8 demonstrates a temperature distribution of the fixing belt 22 in the width direction. In FIG. 8, a horizontal axis represents longitudinal positions in the width direction of the fixing belt 22, expressed as a distance in millimeter from the width center of the fixing belt 22, and the vertical axis represents a surface temperature of the fixing belt 22, that is, the fixing temperature. Further, curbed lines R1 and R2 represent temperature distributions when the consecutive image forming operations are performed with the recording sheet P having the width L1 and when the consecutive image forming operations are performed with the recording sheet P having the width L2, respectively.

It is possible to maintain the temperature distribution of the fixing belt 22 over time during the consecutive image forming operations in a way as shown in FIG. 8 by adjusting, finely over time, the heat reduction area N according to the attitude of the magnetic flux shield plate 29. Thereby, the fixing belt 22 can be free from being overheated at its surface area beyond a width of the recording sheet P and therefore it can be free from a thermal breakdown.

As described above, the image fixing unit 20 of the image forming apparatus 1 controls the heat reduction area N in which the magnetic flux acting on the fixing belt 22 and the support roller 23 is reduced, during the consecutive image forming operations. Thereby, it becomes possible to suppress the temperature rises with reliability at the both sides of the fixing belt 22 and the support roller 23.

In this example, both of the fixing belt 22 having the heat layer and the support roller 23 are used as a heating member. Alternatively, it is possible to use one of the fixing belt 22 and the support roller 23 as a heating member. In such a case, the effect of suppression generated in the image forming apparatus 1, as described above, may be achieved in a similar manner by optimizing the heat reduction area N according to the attitude of the magnetic flux shield plate 29 during the consecutive image forming operations.

In addition, the image forming apparatus 1 may be provided with a halogen heater inside the pressure roller 30. Furthermore, an additional thermistor and oil coating roller may be provided in contact with a circumferential surface of the pressure roller 30. In these cases, the effect of suppression generated in the image forming apparatus 1, as described above, may be achieved in a similar manner.

The image forming apparatus 1 is an example embodiment in a form of a black and white image forming machine; however, it is possible to apply the present invention to a color image forming machine with the effect of suppression generated in the image forming apparatus 1, as described above.

Figure 9A:
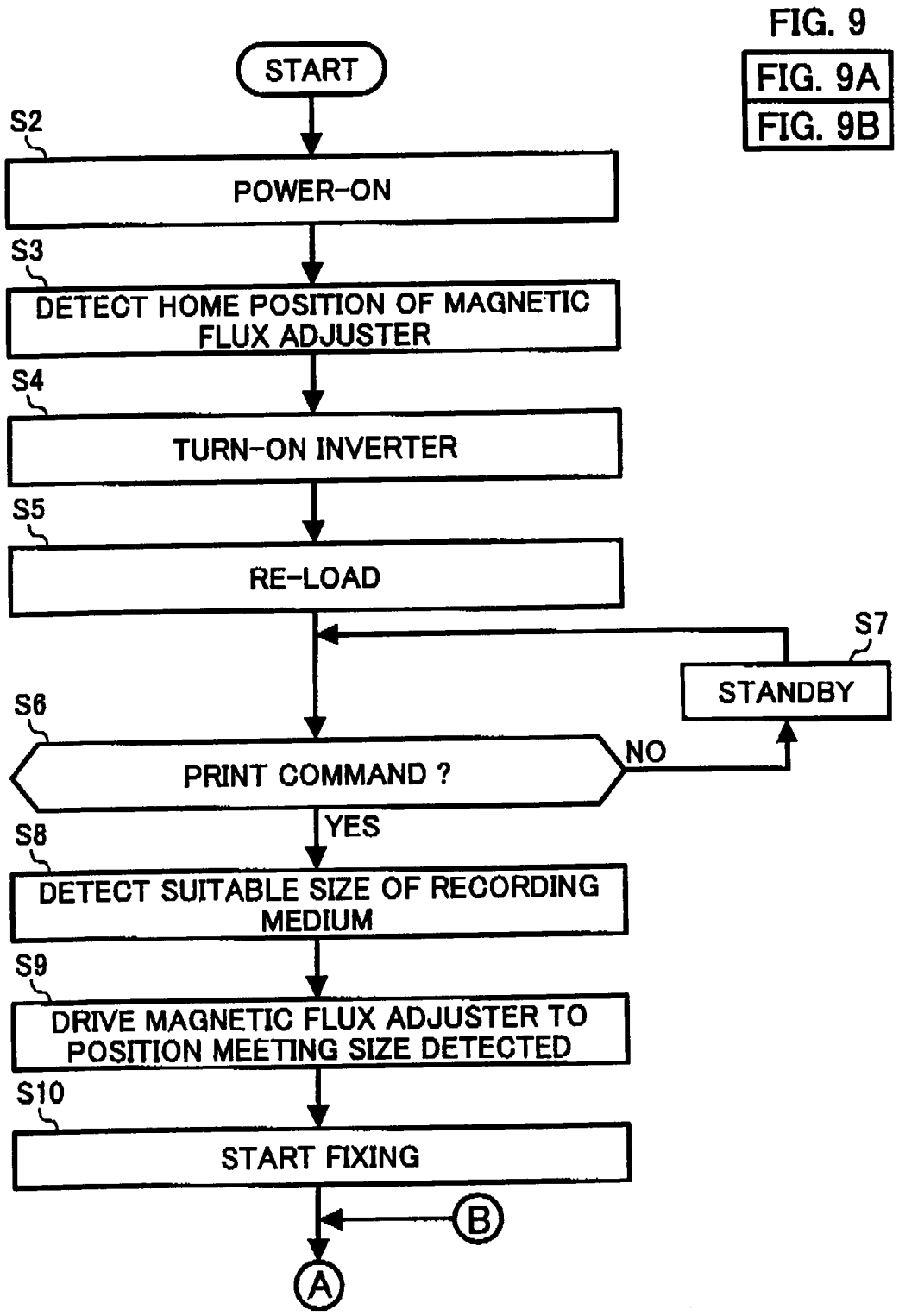
FIG. 9 is a flowchart of an example procedure of another heat-reduction-area control operation performed by the image forming apparatus of FIG. 1.
Figure 9B:
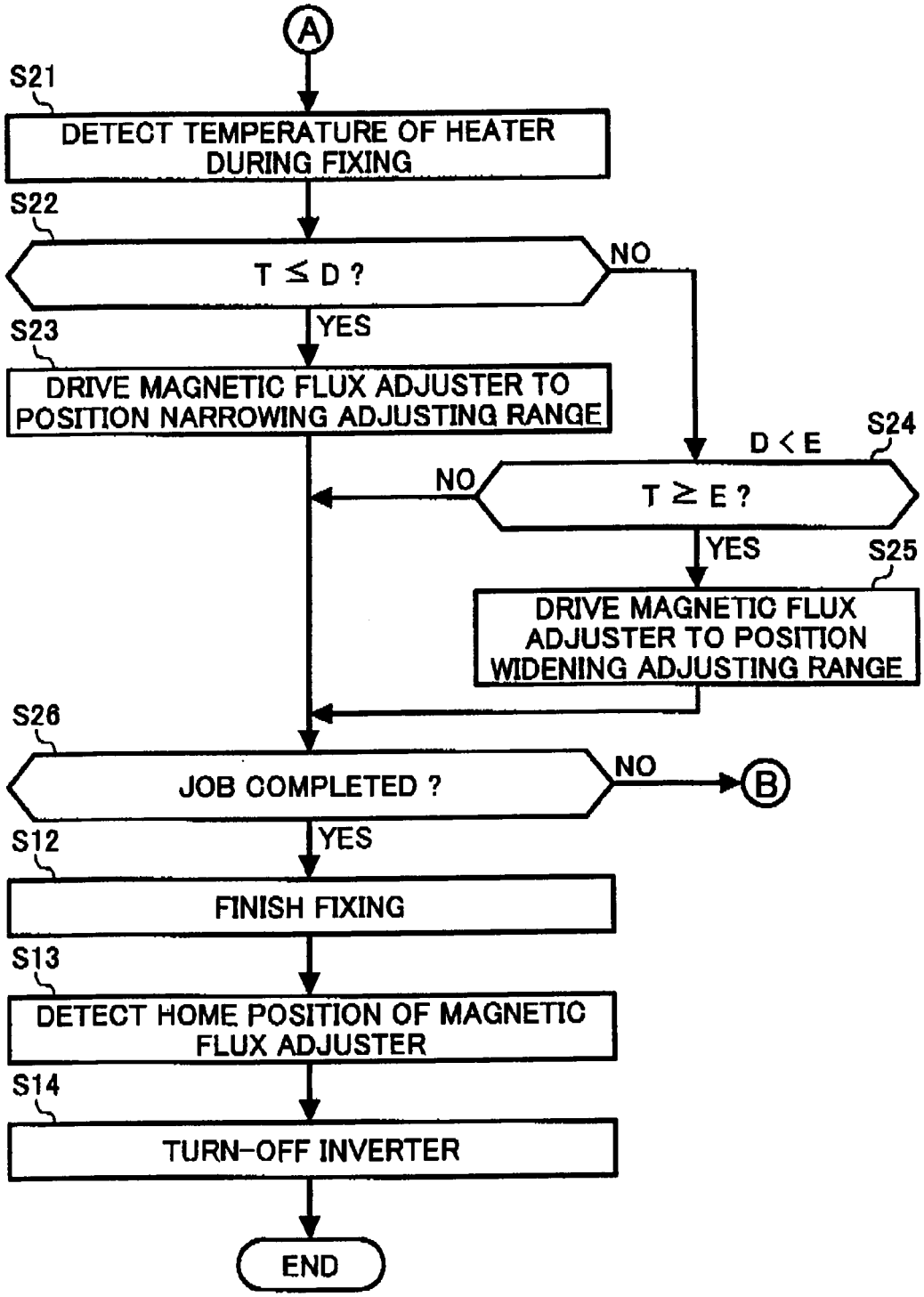

Referring to FIG. 9, another example procedure of the shield-area control operation is explained. In this example, the magnetic flux shield plate 29 is driven based on a temperature detected by the thermopile 37, instead of using the counters to count the count values. The flowchart of FIG. 9 applies Steps S2-S10 of FIG. 5 to its introduction stage and Steps S12-S14 of FIG. 5 to its ending stage, and replaces Step S11 of FIG. 5 with new Steps S21-S26. Therefore, the discussion below avoids repetition of Steps S2-S10 and Steps S12-S14 of FIG. 5, but focuses on new Steps S21-S26.

After the start of the consecutive image forming operations in Step S10, the temperature of the fixing belt 22 is detected by the thermopile 37 in Step S21. The thermopile 37 is arranged at a position to face an approximate width center area of the fixing belt 22. This approximate width center area is out of the heat reduction area N even when the heat reduction area N is changed by the adjustment, thereby making it possible to detect a temperature variation of the fixing belt N at an area out of the heat reduction area N.

Then, in Step S22, a determination is made as to whether a temperature T detected by the thermopile 37 is equal to or lower than a predetermined temperature D. When the temperature T detected by the thermopile 37 is determined in Step S22 as being equal to or lower than the predetermined temperature D, the magnetic flux shield plate 29 is driven in Step S23 so as to shorten the width of the heat reduction area N having a width adjusted in Step S9. Accordingly, the heat of the heating area M is transferred to the shield area N so that a temperature reduction at edges of the sheet-passing area is suppressed while temperature rises at the non-sheet-passing areas are suppressed.

Then, in Step S26, a determination is performed as to whether an image forming job commanded is completed. When the image forming job commanded is determined in Step S26 as not being completed, the processes after Step S21 are repeated. When the image forming job commanded is determined in Step S26 as being completed, the processes of Steps S12-S14 are performed and the procedure ends.

When the temperature T detected by the thermopile 37 is determined in Step S22 as not being equal to or lower than the predetermined temperature D, another determination is made in Step S24 as to whether the temperature T is equal to or greater than a predetermined temperature E which is greater than the predetermined temperature D. When the temperature T is determined in Step S24 as being equal to or greater than the predetermined temperature E, the magnetic flux shield plate 29 is driven in Step S25 so as to lengthen the width of the heat reduction area N having the width adjusted in Step S9. Accordingly, a heat transfer rate from the heating area M to the heat reduction area N is made smaller so that temperature reductions at the non-sheet-passing areas are suppressed.

Then, in Step S26, a determination is performed as to whether an image forming job commanded is completed.

Also, when the temperature T is determined in Step S24 as not being equal to or greater than the predetermined temperature E, the procedure goes to Step S26. When the image forming job commanded is determined in Step S26 as not being completed, the processes after Step S21 are repeated. When the image forming job commanded is determined in Step S26 as being completed, the processes of Steps S12-S14 are performed and the procedure ends.

As described above, in this example, the shield area N having an effect of reducing the magnetic flux active on the fixing belt 22 and the support roller 23 is changed in accordance with the temperature variations detected around the width center of the fixing belt 22, during the consecutive image forming operations. Thereby, a temperature rise at width edges of both fixing belt 22 and support roller 23 is suppressed with reliability.

As described above, in this example, the temperature of the fixing belt 22 which serves as a heating member is directly detected and, based on the detected temperature, the heat reduction area N is varied. As an alternative, a temperature of the support roller 23 which also serves as a heating member may directly be detected in order to be used for a control of the heat reduction area N.

In a case the fixing belt includes no heat layer, that is, the fixing belt is not a heating member but a member to be heated, it is also possible to detect the temperature of the fixing belt and to use the detected temperature for a control of the heat reduction area N. In this case, it is understood that the temperature of a heating member is indirectly detected via the fixing belt.

Figure 10A:
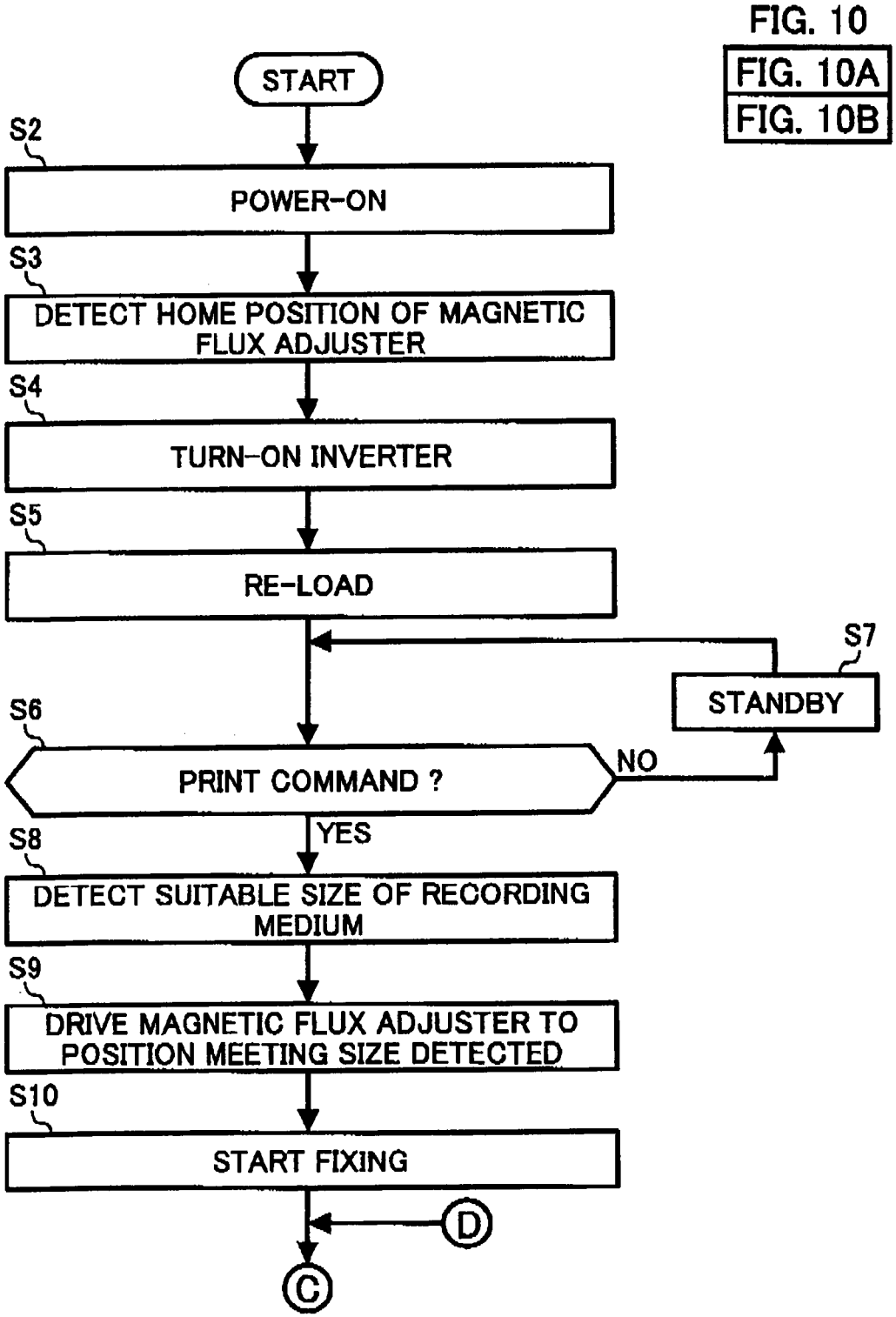
FIG. 10 is a flowchart of an example procedure of another heat-reduction-area control operation performed by the image forming apparatus of FIG. 1.
Figure 10B:
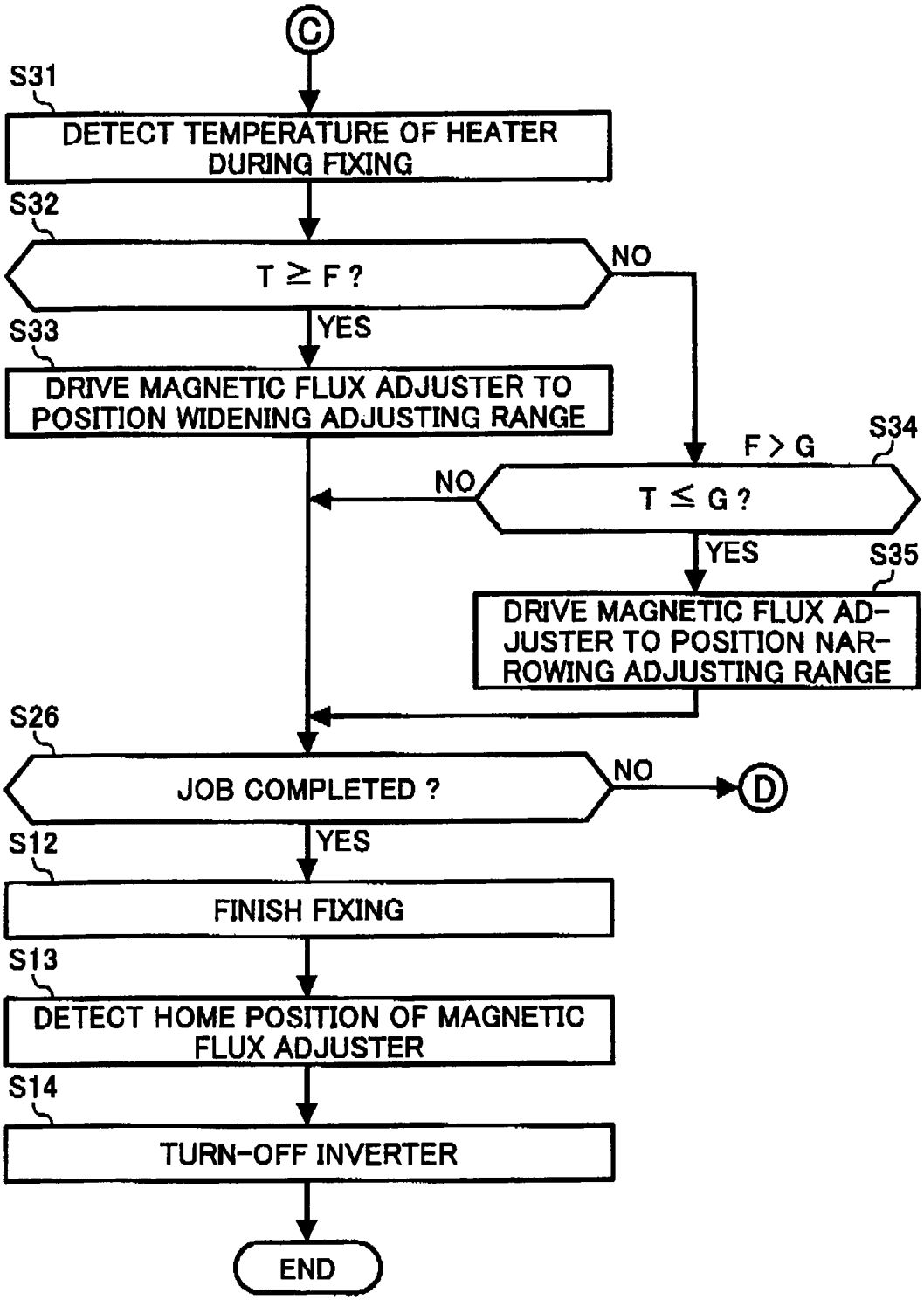
Figure 11:
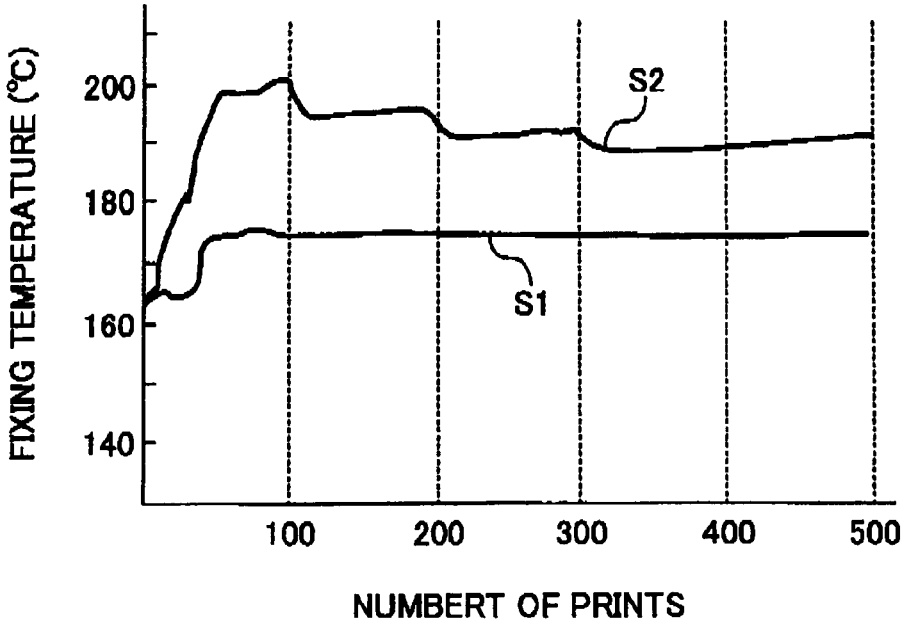
FIG. 11 is a graph showing a relationship between a print number and the fixing temperature when a magnetic flux shield plate is not installed.

Referring to FIGS. 10 and 11, another example procedure of the heat-reduction-area control operation is explained. In this example, the magnetic flux shield plate 29 is driven based on a temperature detected by the thermistor 38 at width edge portions of the fixing belt 22, not at the width center of the fixing belt 22. The flowchart of FIG. 10 applies Steps S2-S10 of FIG. 5 to its introduction stage and Steps S26 of FIG. 9 and S12-S14 of FIG. 5 to its ending stage, and replaces Step S11 of FIG. 5 with new Steps S31-S33. Therefore, the discussion below avoids repetition of Steps S2-S10 and Steps S26 and S12-S14, but focuses on new Steps S31-S35.

After the start of the consecutive image forming operations in Step S10, the temperature of the fixing belt 22 is detected by the thermistor 38 in Step S31. The thermistor 38 is arranged at a position in contact with a width edge area of the fixing belt 22. This width edge area is within the heat reduction area N even when the heat reduction area N is changed by the adjustment, thereby making it possible to detect a temperature variation of the fixing belt N at an area within the heat reduction area N.

Then, in Step S32, a determination is made as to whether a temperature T detected by the thermistor 38 is equal to or greater than a predetermined temperature F. When the temperature T detected by the thermistor 38 is determined in Step S32 as being equal to or greater than the predetermined temperature F, the magnetic flux shield plate 29 is driven in Step S33 so as to widen the width of the heat reduction area N having a width adjusted in Step S9. Accordingly, a heat transfer rate from the heating area M to the heat reduction area N is made smaller so that temperature reductions at the non-sheet-passing areas are suppressed.

Then, in Step S26, a determination is performed as to whether an image forming job commanded is completed. When the image forming job commanded is determined in Step S26 as not being completed, the processes after Step S31 are repeated. When the image forming job commanded is determined in Step S26 as being completed, the processes of Steps S12-S14 are performed and the procedure ends.

When the temperature T detected by the thermistor 38 is determined in Step S32 as not being equal to or greater than the predetermined temperature F, another determination is made in Step S34 as to whether the temperature T is equal to or smaller than a predetermined temperature G which is smaller than the predetermined temperature F. When the temperature T is determined in Step S34 as being equal to or smaller than the predetermined temperature G, the magnetic flux shield plate 29 is driven in Step S35 so as to shorten the width of the heat reduction area N having the width adjusted in Step S9. Accordingly, the heat of the heating area M is transferred to the heat reduction area N so that a temperature reduction at edges of the sheet-passing area is suppressed while temperature rises at the non-sheet-passing areas are suppressed.

Then, in Step S26, a determination is performed as to whether an image forming job commanded is completed. Also, when the temperature T is determined in Step S34 as not being equal to or smaller than the predetermined temperature G, the procedure goes to Step S26. When the image forming job commanded is determined in Step S26 as not being completed, the processes after Step S31 are repeated. When the image forming job commanded is determined in Step S26 as being completed, the processes of Steps S12-S14 are performed and the procedure ends.

FIG. 11 is a graph showing a relationship between a print number by a job of consecutive image forming operations as a horizontal axis and the fixing temperature as a vertical axis, in a case when the magnetic flux shield plate 29 is not installed. In FIG. 11, a curbed line S1 represents variations of the fixing temperature over time in the sheet-passing area, that is, the width middle area of the fixing belt 22. Also, a curbed line S2 represents variations of the fixing temperature over time in the non-sheet-passing area, that is, the width side areas of the fixing belt 22. As illustrated in FIG. 11, the fixing temperature in the sheet-passing area, indicated by the curbed line S1, is relatively low during a time the heating is started and is then soon stabilized. On the other hand, the fixing temperature in the non-sheet-passing area, indicated by the curbed line S2, is relatively low during a time the heating is started and is not stabilized even afterwards. The present example effectively suppresses such a faulty phenomenon before it grows. That is, the present example can stabilize the fixing temperature at the width side areas of the fixing belt 22 so as to suppress an excessive temperature rise by changing the heat reduction area N based on the temperature variations at the width side areas of the fixing belt 22, at which the fixing temperature is not stable.

As described above, in this example, the magnetic flux shield area having an effect of reducing the magnetic flux active on the fixing belt 22 and the support roller 23 is changed in accordance with the temperature variations detected around the width edge area of the fixing belt 22, during the consecutive image forming operations. Thereby, a temperature rise at width edges of both fixing belt 22 and support roller 23 is suppressed with reliability.

Figure 12:
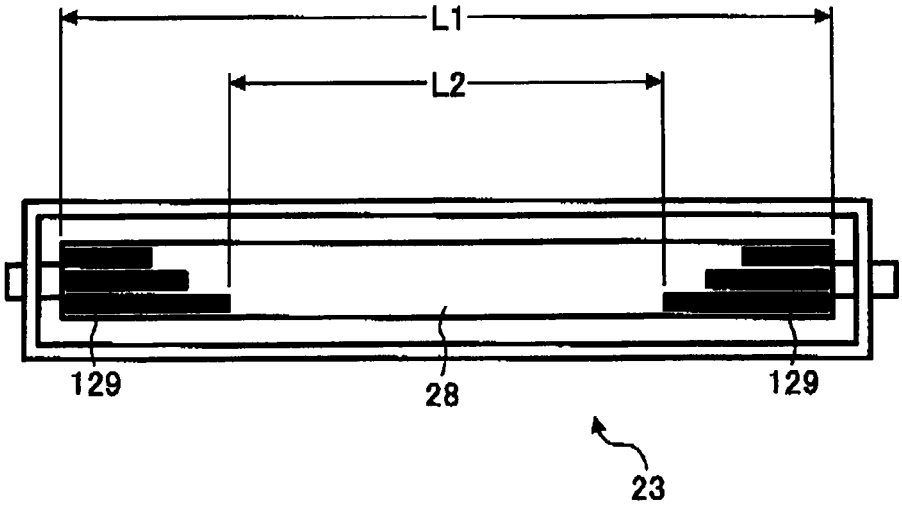
FIG. 12 is a schematic diagram of an interior of another support roller for the image fixing unit shown in FIG. 2.

Referring to FIG. 12, another example magnetic flux shield plate 129 for the support roller 23 of the image fixing unit 20 is explained. FIG. 12 illustrates the support roller 23 in a manner similar to FIG. 3, except for the magnetic flux shield plate 129. The magnetic flux shield plate 129 includes a plurality of copper members having widths different from each other. The magnetic flux shield plate 129 are adhered to a circumferential surface of the internal core 28. The plurality of copper members of the magnetic flux shield plate 129 are arranged so that an area for shutting a circumferential surface of the internal core 28 is gradually decreased or increased from an edge of the internal core 28. Thereby, it becomes possible to vary the magnetic flux shield area in a lateral direction of the internal core 28, which faces the coil 25 of the induction heater 24, by driving the internal core 28 and the magnetic flux shield plate 129 to rotate.

As explained above, the image fixing unit 20 having the magnetic flux shield plate 129 of FIG. 12 can change the magnetic flux shield area to reduce or increase the magnetic flux active on the fixing belt 22 and the support roller 23 during the consecutive image forming operations. Thereby, the image fixing unit 20 having the magnetic flux shield plate 129 of FIG. 12 is capable of suppressing with reliability a temperature rise at the width sides of each of the fixing belt 22 and the support roller 23. Therefore, the image fixing unit 20 having the magnetic flux shield plate 129 of FIG. 12 can achieve the effects performed by the previously described embodiments in a similar manner.

Figure 13:
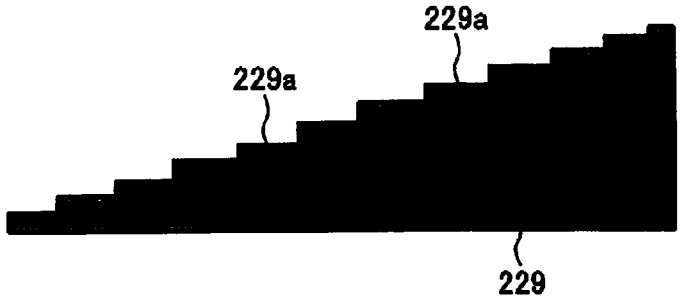
FIGS. 13 and 14 are illustrations for explaining different magnetic flux shield plates.

Referring to FIG. 13, another example magnetic flux shield plate 229 for the support roller 23 of the image fixing unit 20 is explained. FIG. 13 illustrates the magnetic flux shield plate 229 which includes a stepwise slant side 229*a* at each of lateral edge sides thereof. With the stepwise slant side 229*a*, an area for shutting a circumferential surface of the internal core 28 is gradually decreased or increased from an edge of the internal core 28.

As is in the previously explained examples, this example can also drive the magnetic flux shield plate 229 to precisely control the magnetic flux shield area by which the magnetic flux in the width direction of the fixing belt 22 can be changed in accordance with the heating time or the temperature of the fixing belt 22.

As explained above, the image fixing unit 20 having the magnetic flux shield plate 229 of FIG. 13 can change the magnetic flux shield area to reduce or increase the magnetic flux active on the fixing belt 22 and the support roller 23 during the consecutive image forming operations. Thereby, the image fixing unit 20 having the magnetic flux shield plate 229 of FIG. 13 is capable of suppressing with reliability a temperature rise at the width sides of each of the fixing belt 22 and the support roller 23. Therefore, the image fixing unit 20 having the magnetic flux shield plate 229 of FIG. 13 can achieve the effects performed by the previously described embodiments in a similar manner.

Figure 14:
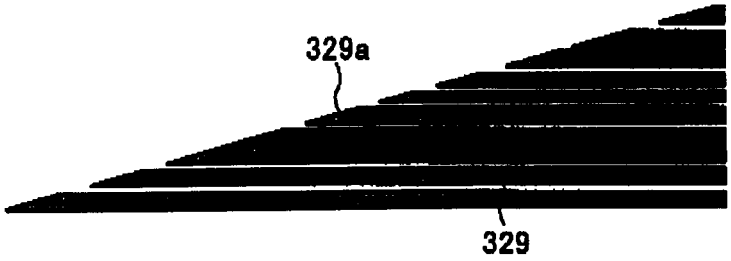

Further, referring to FIG. 14, another example magnetic flux shield plate 329 for the support roller 23 of the image fixing unit 20 is explained. FIG. 14 illustrates the magnetic flux shield plate 329 which includes a plurality of copper members having widths different from each other and tapered side edges, as illustrated in FIG. 14. The magnetic flux shield plate 329 are adhered to a circumferential surface of the internal core 28. The plurality of copper members of the magnetic flux shield plate 329 are arranged so that an area for shutting a circumferential surface of the internal core 28 is gradually decreased or increased from an edge of the internal core 28. Thereby, it becomes possible to vary the magnetic flux shield area in a lateral direction of the internal core 28, which faces the coil 25 of the induction heater 24, by driving the internal core 28 and the magnetic flux shield plate 329 to rotate.

As is in the previously explained examples, this example can also drive the magnetic flux shield plate 329 to precisely control the magnetic flux shield area by which the magnetic flux in the width direction of the fixing belt 22 can be changed in accordance with the heating time or the temperature of the fixing belt 22.

As explained above, the image fixing unit 20 having the magnetic flux shield plate 329 of FIG. 14 can change the magnetic flux shield area to reduce or increase the magnetic flux active on the fixing belt 22 and the support roller 23 during the consecutive image forming operations. Thereby, the image fixing unit 20 having the magnetic flux shield plate 329 of FIG. 14 is capable of suppressing with reliability a temperature rise at the width sides of each of the fixing belt 22 and the support roller 23. Therefore, the image fixing unit 20 having the magnetic flux shield plate 329 of FIG. 14 can achieve the effects performed by the previously described embodiments in a similar manner.

Figure 15:
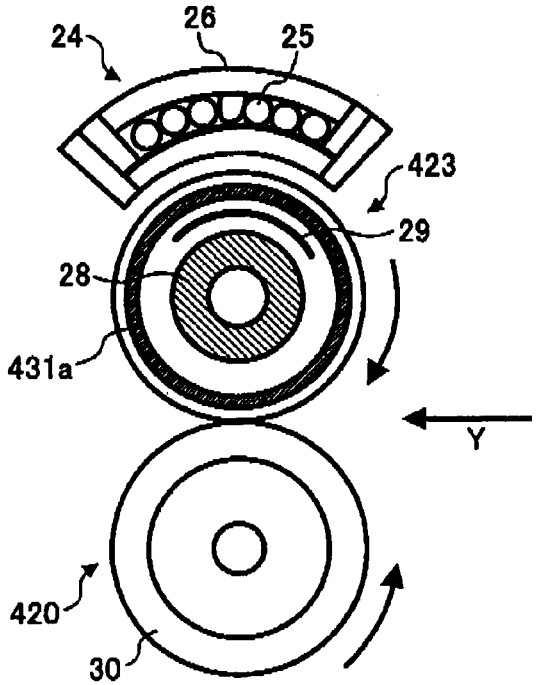
FIG. 15 is a schematic diagram of another image fixing unit of the image forming apparatus shown in FIG. 1.

Referring to FIG. 15, another example image fixing unit 420 is explained. FIG. 15 illustrates the image fixing unit 420 which has a structure similar to the image fixing unit 20 of FIG. 2, except for a fixing roller 423 which combines the functions of the fixing belt 22 and the support roller 23 of FIG. 2. That is, the fixing roller 423 of FIG. 15 serves as a fixing member as well as a heating member.

The fixing roller 423 includes a heat layer 423*a*, an elastic layer (not shown), and a release layer. The elastic layer mainly includes a silicone rubber, and the release layer mainly includes a fluorine compound. The fixing roller 423 has a shape of hollow circular cylinder in which the internal core 28 and the magnetic flux shield plate 29 are held for rotation.

The induction heater 24 includes the coil 25, the core 26, and the coil guide 27, as described in the previous example of FIG. 2. The coil 25 is configured to receive an application of an alternating current having a frequency in the range of from approximately 10 kHz to approximately 1 MHz. As a result, magnetic lines of force are generated between the core 26 and the core 28 and the fixing roller 423 is consequently heated by the action of an electromagnetic induction. The thus-heated fixing roller applies heat to the toner image carried on the recording sheet P transferred thereto in the direction Y. Thereby, the toner image is melt and fixed on the recording sheet P while passing through the gap between the fixing roller 423 and the pressure roller 30.

As described above, this example changes the magnetic flux shield area by which the magnetic flux in the width direction of the fixing roller 423 can be changed in accordance with the heating time or the temperature of the fixing roller 423 during the consecutive image forming operations. Thereby, a temperature rise of the fixing roller 423 in the width direction can be suppressed with reliability.

Figure 16:
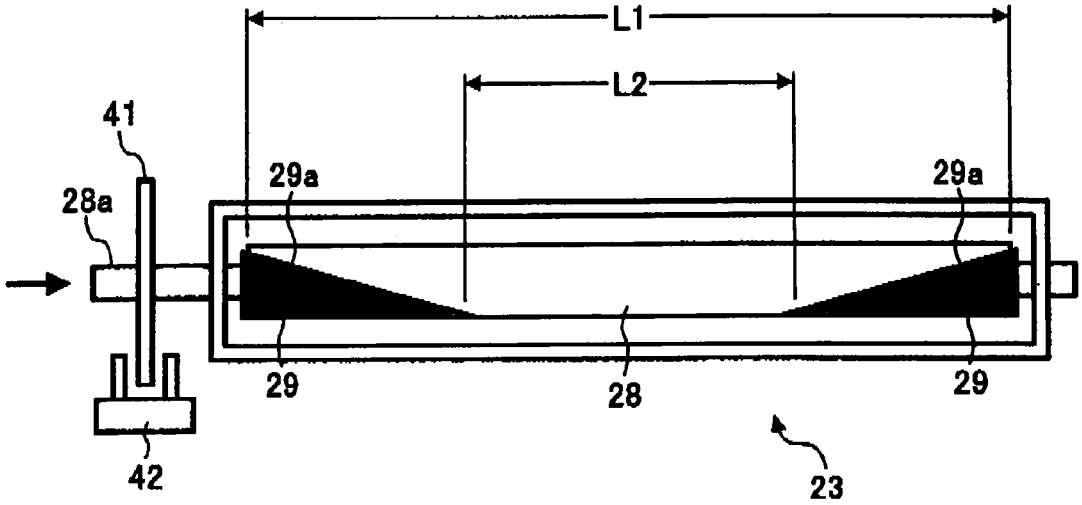
FIG. 16 is a schematic diagram of a home position detector engaged with the support roller.
Figure 17:
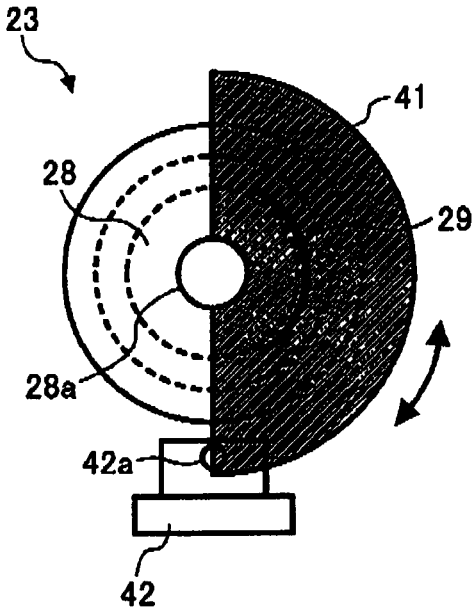
FIG. 17 is a schematic diagram of the home position detector seen in a direction indicated by an arrow.

Referring to FIG. 16, an example detector for the home position of the support roller 23 is explained. As illustrated in FIG. 16, the internal core 28 of the support roller 23 illustrated in FIG. 3 has a shaft 28*a* to which a disc 41 is provided. The internal core 28 and the shaft 28*a* are engaged with each other, and the disc 41 is rotated together with the core 28 and the magnetic flux shield plate 29 when the shaft 28*a* of the internal core 28 is driven to rotate. As illustrated in FIG. 17, the disc 41 has a half circle shape and is arranged to be linked with the position of the magnetic flux shield plate 29. In other words, the position of the magnetic flux shield plate 29 can be recognized by detecting the attitude of the half round disc 41. To detect the attitude of the disc 41, a transmissive photosensor 42 is provided in the vicinity of the disc 41. The transmissive photosensor 42 includes a light emitting element such as a laser diode and a light sensitive element such as a photodiode, and is configured to detect the disc 41 when a radial edge of the half round the disc 41 is driven to move in either of a clockwise or counterclockwise direction and passes a position 42*a* between the light emitting element and the light sensitive element. By detecting the position of the disc 41 in this way, the position of the magnetic flux shield plate 29 which is engaged with the disc 41 is determined. For example, as illustrated in FIG. 17, when the internal core 28 is rotated clockwise so that the detection status of the disc 41 by the transmissive photosensor 42 is changed from a status of "being not detected" to a status of "being detected" when the radial edge of the half round the disc 41 passes the position 42*a*. At this moment, the magnetic flux shield plate 29 is recognized at a position, as illustrated in FIG. 17. This position is referred to as a home position of the magnetic flux shield plate 29.

With this example structure described above, the magnetic flux shield plate 29 is initially returned to the home position and is then subjected to the heat-reduction-area control operation in accordance with the size of the recording sheet P.

Figure 18:
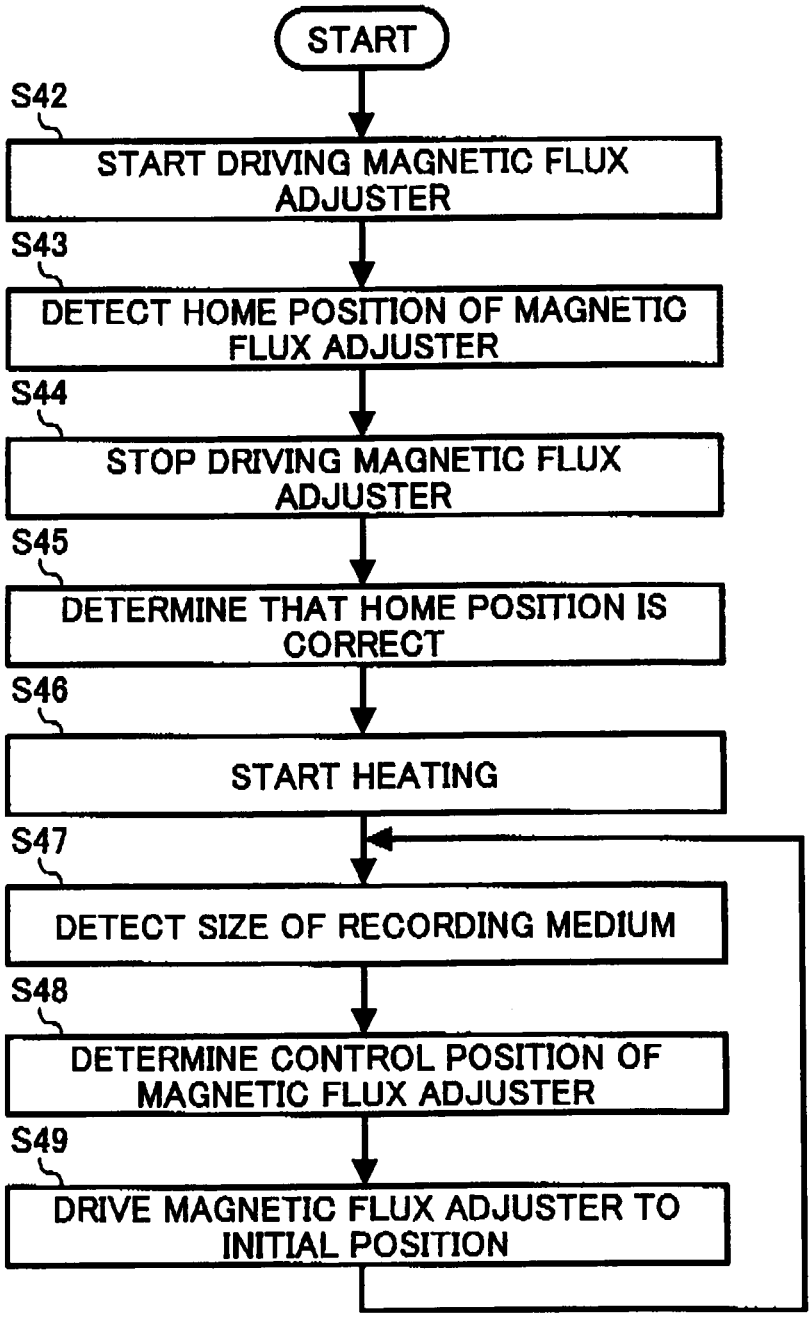
FIG. 18 is a flowchart of an example procedure of a heat-reduction-are control operation performed by the image forming apparatus of FIG. 1.
Figure 19A:
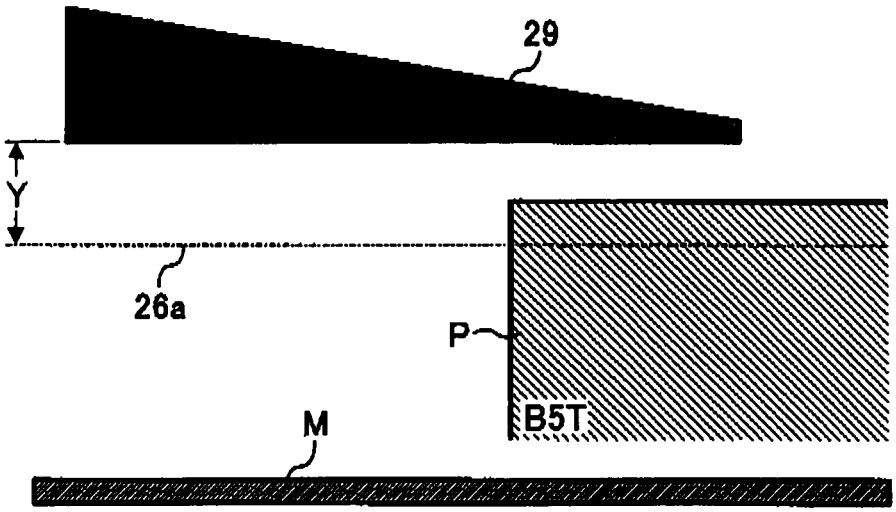
FIGS. 19A and 19B are schematic diagrams for explaining a home position of the magnetic flux shield plate and its position for an image forming on a recording sheet in a B5T size.
Figure 19B:
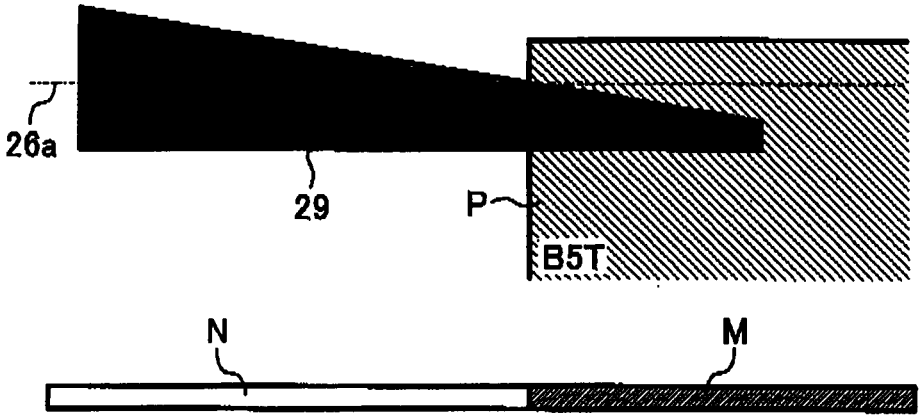

Referring to FIGS. 18 and 19A and 19B, an example procedure of the shield area control operation performed by the image fixing unit 20 is explained. FIG. 18 is a flowchart of an example procedure of the heat-reduction-area control operation according to an embodiment of the present invention. FIG. 19A demonstrates a condition in that the magnetic flux shield plate 29 is at its home position where the magnetic flux shield plate 29 does not intervene and no heat reduction area N of the magnetic flux is formed. FIG. 19B shows a condition in that the magnetic flux shield plate 29 is moved to a position where the magnetic flux shield plate 29 intervenes the magnetic flux in an area outside the recording sheet P, i.e., the non-sheet-passing area. In this case, the magnetic flux shield area N for the magnetic flux is formed around the non-sheet-passing area.

When the image forming apparatus 1 is energized, the image fixing unit 20 starts the heat-reduction-area control operation in which the magnetic flux shield plate 29 is initially needed to return to its home position. In Step S42 of FIG. 18, the magnetic flux shield plate 29 is driven to rotate together with the internal core 28 and the disc 41. Then, the transmissive photosensor 42 detects the radial edge of the disc 41, in Step S43. By this detection, it is determined that the magnetic flux shield plate 29 is at the home position. At the home position, the magnetic flux shield plate 29 is away from the center core 26*a* by a distant Y along the circumferential surface of the core 26 in the circumferential direction of the core 26, as illustrated in FIG. 19A, so that no magnetic flux shield area is formed and the entire width of the internal core 28 is exposed to the magnetic flux. In other words, at this time, the heat reduction area N of the support roller 23 is null and the heating area M is applied to the entire width of the support roller 23.

Then, the magnetic flux shield plate 29 is stopped in Step S44, and the home position of the magnetic flux shield plate 29 is determined in Step S45. Subsequently, the inverter power source circuit, i.e., the high-frequency power source is energized and accordingly heating by the induction heater 24 is started, in Step S46.

Then, the sheet size detector 11*a*, for example, detects the size of the recording sheet P in accordance with an image forming command entered by an operator, in Step S47. Based on the sheet size detected by the sheet size detector 11*a*, for example, an initial control position of the magnetic flux shield plate 29 is determined, in Step S48. Then, in Step S49, the magnetic flux shield plate 29 is turned to the initial control position.

More specifically, when the sheet size of the recording sheet P detected by the sheet size detector 11*a*, for example, is B5T (i.e., B5 landscape), the magnetic flux shield plate 29 is driven to turn from the home position, as illustrated in FIG. 19A, to the initial control position, as illustrated in FIG. 19B. Thus, the heat reduction area N is approximately equal to the non-sheet-passing area, that is, outside the recording sheet P of B5T size. In addition, the heating area M is approximately equal to the sheet-passing area, that is, within the width of the recording sheet P of B5T size.

At each time a series of fixing operations is performed, the processes of Steps S47-S49 are repeated, and the procedure of the image forming job ends.

In this example, the position of the magnetic flux shield plate 29 is adjusted so that the heat reduction area N and the heating area M are in accordance with the non-sheet-passing area and the sheet-passing area, respectively, as illustrated in FIGS. 19A and 19B. However, it is preferable to adjust the position of the magnetic flux shield plate 29 in accordance with the distribution of temperature of the fixing belt 22 or the support roller 23 in the width direction, as illustrated in FIGS. 6A-6C.

With the structure of the support roller 23 with the disc 41 and the transmissive photosensor 42, the magnetic flux shield plate 29 is initially moved to the home position and is then adjusted in accordance with the size of the recording sheet P, thereby improving variation accuracy of the heat reduction area N. As a result, the distribution of temperature with respect to the fixing belt 22 is constantly maintained in a shape, as illustrated in FIG. 8. Therefore, the temperature rise of the fixing belt 22 is suppressed in the heat reduction area N and the fixing belt 22 would not cause a thermal damage.

As described above, in this example, the image forming apparatus 1 controls the magnetic flux shield plate 29 based on the width information of the recording sheet P and the position of the magnetic flux shield plate 29. Thereby, the heat reduction N is accurately adjusted and the temperature rise of the fixing belt 22 and the support roller 23 is suppressed in the width direction with reliability.

This example uses the fixing belt 22 including the heat layer and the support roller 23 as heat members. As an alternative, not both but one of the fixing belt 22 and the support roller 23 may be used as a heat member. Even with such a structure, the fixing procedure can be performed in a similar manner with a similar effect.

Further, in this example, the pressure roller 30 may be provided internally with a halogen heater. Also, it is possible to provide a thermistor and an oil coating roller at positions in contact with the outer circumferential surface of the pressure roller 30.

Furthermore, the image forming apparatus 1 is, as described above, a black and white image forming machine; however, the present invention can easily be applied to a color image forming apparatus.

As a further alternative, it is possible to use a reflection type photosensor instead of the transmissive photosensor 42. In using the transmissive photosensor, an absence of the disc 41 is determined when the light sensitive element detects the light emitted by the light emitting element. However, in using the reflection type photosensor, a presence of the disc 41 is determined when the light sensitive element detects a reflected light of the light emitted by the light emitting element.

Figure 20:
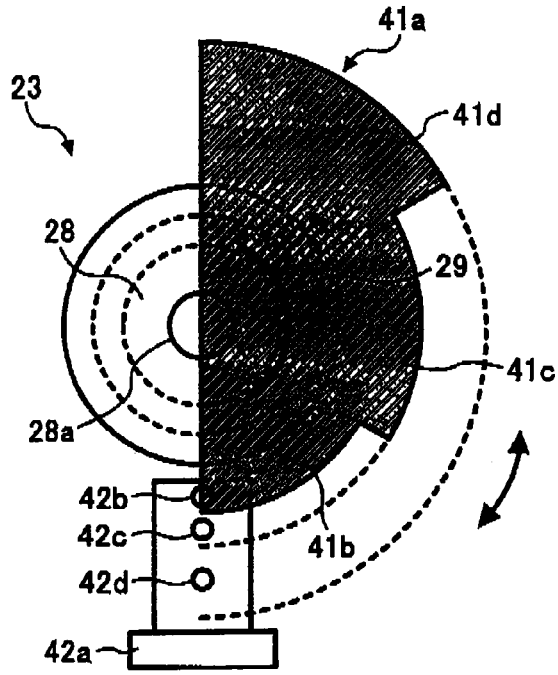
FIG. 20 is a schematic diagram of another home position detector engaged with the support roller.

Referring to FIG. 20, another example detector for detecting the home position with respect to the support roller 23 is explained. As illustrated in FIG. 20, the support roller 23 is provided with a disc 41*a* which includes a first section 41*b*, a second section 41*c*, and a third section 41*c*. The support roller 23 is also provided with a transmissive photosensor 42*a* which includes light sensitive elements 42*b*, 42*c*, and 42*d*, each of which is paired with a light emitting element (not shown).

The first, second, and third sections 41*b*, 41*c*, and 41*d* have fan-like shapes with different radiuses and are arranged one another. These sections correspond to the variations of the heat reduction area N. For example, the first section 41*b* corresponds to the heat reduction area N for a sheet size of A3T, that is, a A3-size recording sheet in landscape orientation. Similarly, the second section 41*c* corresponds to the heat reduction area N for a sheet size of A4T, that is, a A4-size recording sheet in landscape orientation, and the third section 41*d* corresponds to the heat reduction area N for a sheet size of A5T, that is, a A5-size in landscape orientation.

The disc 41*a* is turned in a manner similar to the disc 41 of FIG. 17, when the internal core 28 is driven to rotate together with the magnetic flux shield plate 29. The light sensitive elements 42*b*, 42*c*, and 42*d* are arranged at positions corresponding to the first, second, and third sections 41*b*, 41*c*, and 41*d* so that, when the disc 41*a* is turned, the first section 41*b* is detected by the light sensitive element 42*b*, the second section 41*c* is detected by the light sensitive element 42*c*, and the third section 41*d* is detected by the light sensitive element 42*d*.

When the disc 41*a* is turned by a degree so that the photosensor 42*a* only detects the first section 41*b*, the heat reduction area N corresponds to the recording sheet of A3T. Similarly, the heat reduction area N corresponds to the recording sheet of A4T when the photosensor 42*a* detects the first and second sections 41*b* and 41*c*. Further, the heat reduction area N corresponds to the recording sheet of A5T when the photosensor 42*a* detects the first, second, and third sections 41*b*, 41*c*, and 41*d*. In this way, the photosensor 42*a* directly detects the attitude of the magnetic flux shield plate 29.

In this example, the detectors for the home position of the magnetic flux shield plate 29 using the photosensor such as the transmissive photosensors 42 and 42*a* or the like is applied to the image fixing unit employing the support roller shown in FIG. 3. However, such a home position detector can also be applied to the image fixing units employing variations of the support rollers shown in FIG. 12, for example. Further, the home position detector can be applied to the cases that employ the variations of the magnetic flux shield plate shown in FIGS. 13 and 14, for example. Further, the home position detector can also be applied to the image fixing unit shown in FIG. 15, for example.

Figure 21A:
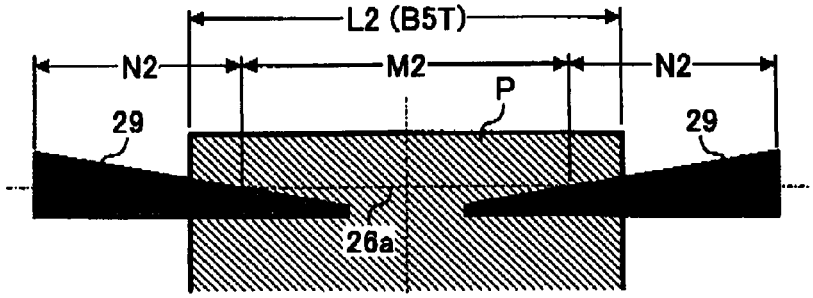
FIGS. 21A and 21B are schematic diagrams showing relationships among the magnetic flux shield plate, the heating area, the heat reduction area, the center core, and the recording sheet in the width direction of the support roller.
Figure 21B:
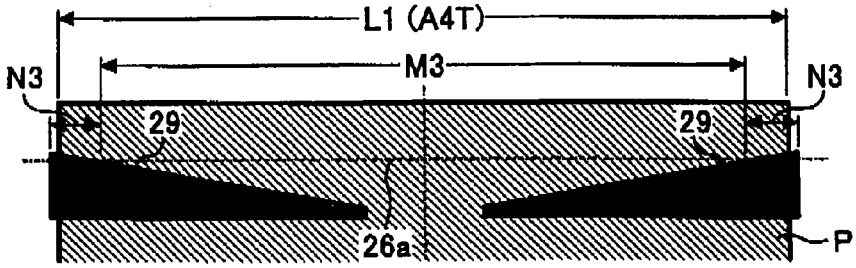

Referring to FIGS. 21A and 21B, an example procedure of another heat-reduction-area control operation for the image fixing unit 20 is explained. FIG. 21A demonstrates a case in which the recording sheet P in a B5T size is used and FIG. 21B demonstrates a case in which the recording sheet P in a A4T size. In this example, the magnetic flux shield plate 29 is rotated so that the heating area M is made as included in the sheet-passing area which is equivalent to the width L.

In a case of the recording sheet P of B5T having the width L2, the magnetic flux shield plate 29 is rotated to shield a part of the center core 26*a* so as to change the heat reduction area N to a heat reduction area N2 on each side of the support roller 23, entering into the width L2 of B5T by a marginal distance. Accordingly, the heating area M is changed to a heating area M2 which is narrower than the width L2, as illustrated in FIG. 21A. The above marginal distance is expressed as (L2−M2)/2.

Subsequently, the inverter power source circuit of the image fixing unit 20 is energized so that the induction heater 24 is caused to start heating. The time of energizing the inverter power source circuit is not limited to it and can be executed before starting the rotation of the magnetic flux shield plate 29, for example.

In a case of the recording sheet P of B4T having the width L1, the magnetic flux shield plate 29 is rotated to shield a part of the center core 26*a* so as to change the heat reduction area N to a heat reduction area N3 on each side of the support roller 23, entering into the width L1 of B4T by a marginal distance. Accordingly, the heating area M is changed to a heating area M3 which is narrower than the width L2, as illustrated in FIG. 21A. The above marginal distance is expressed as (L1−M3)/2.

Subsequently, the inverter power source circuit of the image fixing unit 20 is energized so that the induction heater 24 is caused to start heating.

Figure 22A:
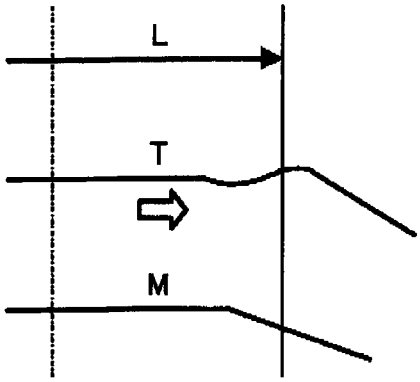
FIGS. 22A and 22B are illustrations schematically showing a distribution of the fixing temperature when the heating area is changed.
Figure 22B:
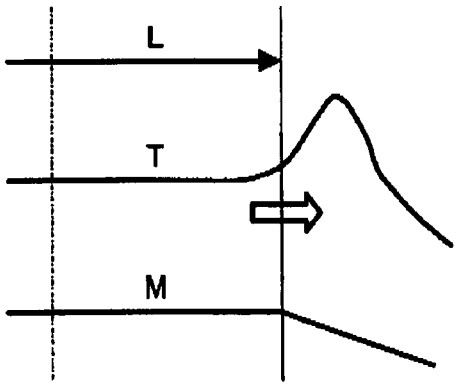

As described above, this example drives the magnetic flux shield plate 29 so that the heating area M is made as included in the sheet-passing area which is equivalent to the width L. Therefore, a leveling of the temperature distribution can be performed with consideration of thermal transmission from the heating area M to the heat reduction area N, as shown in comparative illustrations of FIGS. 22A and 22B, wherein L is the width of the recording sheet P, T is the temperature, and M is the heating area.

Furthermore, since this example drives the magnetic flux shield plate 29 so that the heating area M is made as included in the sheet-passing area which is equivalent to the width L, the distribution of temperature with respect to the fixing belt 22 is constantly maintained in a shape, as illustrated in FIG. 8. Therefore, the temperature rise of the fixing belt 22 is suppressed in the heat reduction area N and the fixing belt 22 would not cause a thermal damage.

This example uses the fixing belt 22 including the heat layer and the support roller 23 as heat members. As an alternative, not both but one of the fixing belt 22 and the support roller 23 may be used as a heat member. Even with such a structure, the fixing procedure can be performed in a similar manner with a similar effect.

Further, in this example, the pressure roller 30 may be provided internally with a halogen heater. Also, it is possible to provide a thermistor and an oil coating roller at positions in contact with the outer circumferential surface of the pressure roller 30.

Furthermore, the image forming apparatus 1 is, as described above, a black and white image forming machine; however, the present invention can easily be applied to a color image forming apparatus.

Still further, this example procedure of the heat-reduction-area control operation can also be applied to the image fixing units employing variations of the support rollers shown in FIG. 12, for example. Further, the example procedure of the heat-reduction-area control operation can be applied to the cases that employ the variations of the magnetic flux shield plate shown in FIGS. 13 and 14, for example. Further, the example procedure of the heat-reduction-area control operation can also be applied to the image fixing unit shown in FIG. 15, for example.

Figure 23:
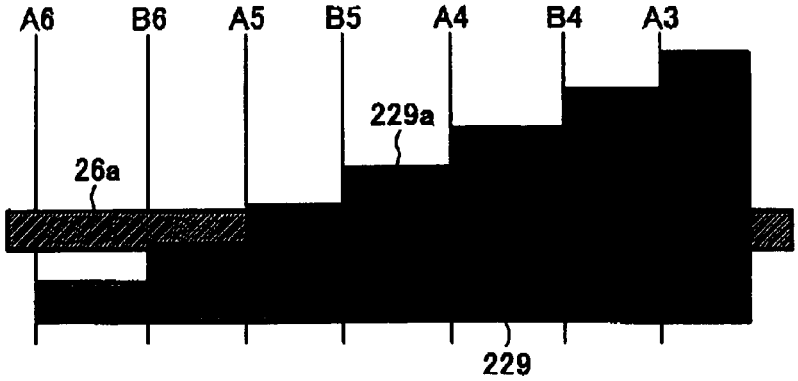
FIGS. 23 and 24 are schematic diagrams of an example procedure of another heat-reduction-area control operation performed by the image fixing unit of FIG. 2.
Figure 24:
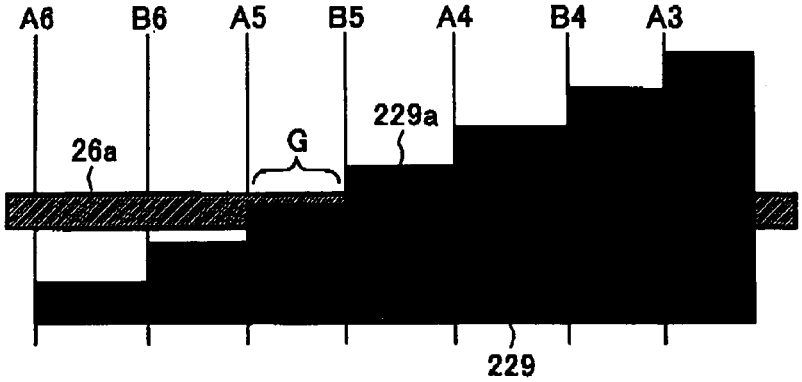

Referring to FIGS. 23 and 24, an example procedure of another heat-reduction-area control operation for the image fixing unit 20 is explained. This image forming unit 20 includes the magnetic flux shield plate 229 of FIG. 13 for the support roller 23. As explained above, the magnetic flux shield plate 229 of FIG. 13 includes the stepwise slant side 229*a* at each of lateral edge sides thereof. With the stepwise slant side 229*a*, an area for shutting a circumferential surface of the internal core 28 is stepwise decreased or increased from an edge of the internal core 28.

As illustrated in FIG. 23, the stepwise slant side 229*a* of the magnetic flux shield plate 229 has seven steps prepared for different sizes of the recording sheet P: A6, B6, A5, B5, A4, B4, and A3, for example. Therefore, in this example, the heating area M can be changed in seven steps. For example, the illustration of FIG. 23 demonstrates a condition of the magnetic flux shield plate 229 in a case of the recording sheet P of A5, in which the magnetic flux shield plate 229 is appropriately positioned relative to the center core 26*a* for the recording sheet P of A5. Under this condition, the heating area M is substantially equivalent to the width L of the recording sheet P, that is, the width of A5. In this example, the magnetic flux shield plate 229 is rotated so that the heat reduction area N faces the non-sheet-passing area and the heating area M faces the sheet-passing area which is equivalent to the width L.

In this way, the image fixing unit 20 using the magnetic flux shield plate 229 can handle the recording sheets P in various sheet sizes such as A6, B6, A5, B5, A4, B4, and A3, for example.

As illustrated in FIG. 23, the stepwise slant side 229*a* is a leading side when the magnetic flux shield plate 229 is rotated. Therefore, as demonstrated in FIG. 24, when the magnetic flux shield plate 229 is positioned with a slight positional error in the sheet transportation direction relative to the center core 26*a* for the recording sheet P of A5, the positional error is extended only for a distance G, in the width direction, which is relatively small. That is, when the magnetic flux shield plate 229 is moved inaccurately by an erroneous distance (e.g., the distance G), such an erroneous distance is not caused across the magnetic flux shield plate 220 but is restricted within a relatively small range.

As described above, since, in this example, the leading side, that is, the stepwise slant side 229*a* of the magnetic flux shield plate 229 has a plurality of steps, the distribution of temperature with respect to the fixing belt 22 can constantly be maintained in a shape, as illustrated in FIG. 8, even when the magnetic flux shield plate 229 is moved with a slight error. Therefore, the temperature rise of the fixing belt 22 is suppressed in the heat reduction area N and the fixing belt 22 would not cause a thermal damage.

This example uses the fixing belt 22 including the heat layer and the support roller 23 as heat members. As an alternative, not both but one of the fixing belt 22 and the support roller 23 may be used as a heat member. Even with such a structure, the fixing procedure can be performed in a similar manner with a similar effect.

Further, in this example, the pressure roller 30 may be provided internally with a halogen heater. Also, it is possible to provide a thermistor and an oil coating roller at positions in contact with the outer circumferential surface of the pressure roller 30.

Furthermore, the image forming apparatus 1 is, as described above, a black and white image forming machine; however, the present invention can easily be applied to a color image forming apparatus.

Still further, this example procedure of the heat-reduction-area control operation can also be applied to the image fixing units employing variations of the support rollers shown in FIG. 12, for example. Further, the example procedure of the heat-reduction-area control operation can be applied to the cases that employ the variations of the magnetic flux shield plate shown in FIGS. 13 and 14, for example. Further, the example procedure of the heat-reduction-area control operation can also be applied to the image fixing unit shown in FIG. 15, for example.

In this example, the magnetic flux shield plate 229 is adjusted to change the heat reduction area N and the heating area M based on the detection result by the sheet detector 11*a*, 12*a*, or 15*a*. However, as an alternative, it is possible to adjust the magnetic flux shield plate 229 in accordance with the detection result by the sheet thickness detector 1*a*. This arrangement is particularly effective for a case in which heating efficiencies of the fixing belt 22 and the support roller 23 are susceptible to the change of a thickness of the recording sheet P. With such an arrangement, a temperature rise at both sides of the fixing belt 22 and the support roller 23 in the width direction can be suppressed with reliability, regardless of variations of the thickness of the recording sheet P.

When heating efficiencies of the fixing belt 22 and the support roller 23 are susceptible to the change of a thickness of the recording sheet P, the sheet thickness detector 1*a* is used to detect a sheet kind of the recording sheet P, and the magnetic flux shield plate 229 is adjusted in accordance with the detection result by the sheet thickness detector 1*a*. With such an arrangement, a temperature rise at both sides of the fixing belt 22 and the support roller 23 in the width direction can be suppressed with reliability, regardless of variations of the kind of the recording sheet P.

As another alternative to the detection result by the sheet detector 11*a*, 12*a*, or 15*a*, it is possible to adjust the magnetic flux shield plate 229 in accordance with the detection result by the transfer speed detectors 1*b* and 1*c*. This arrangement is particularly effective for a case in which the image forming apparatus is capable of changing the sheet transfer speed and in which heating efficiencies of the fixing belt 22 and the support roller 23 are susceptible to the change of the sheet transfer speed. With such an arrangement, a temperature rise at both sides of the fixing belt 22 and the support roller 23 in the width direction can be suppressed with reliability, regardless of variations of the sheet transfer speed of the recording sheet P.

As another alternative to the detection result by the sheet detector 11*a*, 12*a*, or 15*a*, it is possible to adjust the magnetic flux shield plate 229 in accordance with the detection result by the environment detector 1*d*. This arrangement is particularly effective for a case in which heating efficiencies of the fixing belt 22 and the support roller 23 are susceptible to the change of environmental factors such as a temperature and humid, for example. With such an arrangement, a temperature rise at both sides of the fixing belt 22 and the support roller 23 in the width direction can be suppressed with reliability, regardless of variations of the environmental factors such as a temperature and humid, for example.

Figure 25:
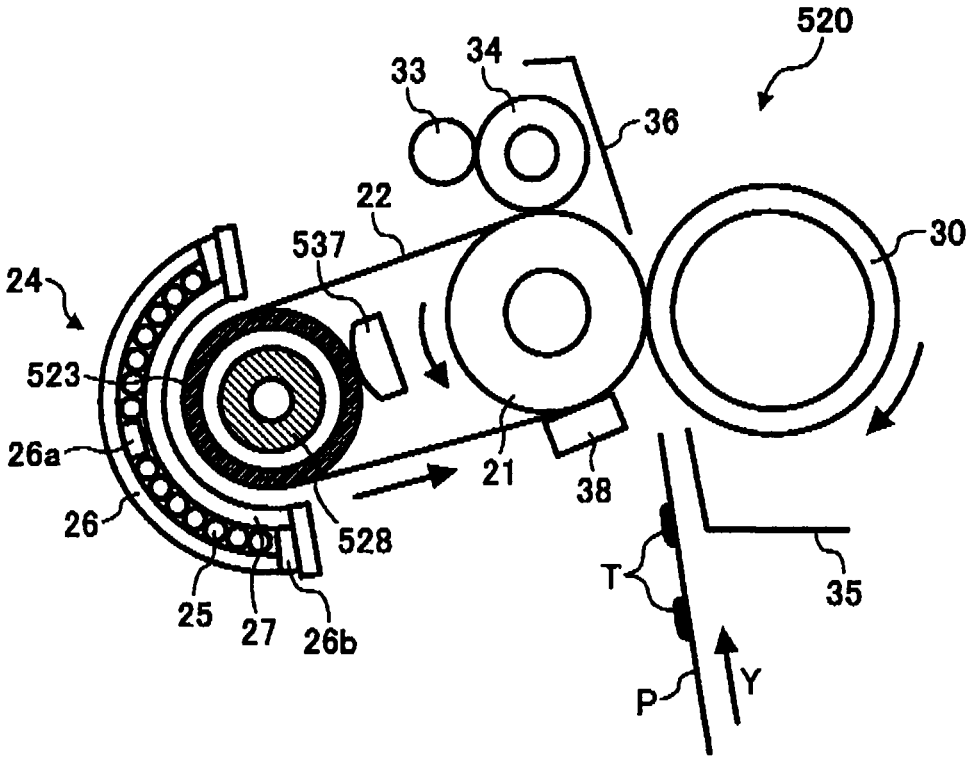
FIG. 25 is a schematic diagram of another image fixing unit for the image forming apparatus shown in FIG. 1.

Referring to FIG. 25, another example image fixing unit 520 is explained. FIG. 25 illustrates the image fixing unit 520 which has a structure similar to the image fixing unit 20 of FIG. 2, except for a support roller 523 and a thermostat 537. The support roller 523 includes an internal core 528 having no magnetic flux shield plate. The thermostat 537 is arranged in contact with an outer circumferential surface of the support roller 523.

As described above, the thermistor 38 arranged in contact with the outer circumferential surface of the fixing belt 22 is configured to regularly detect the fixing temperature from the surface of the fixing belt 22. The inverter power source circuit is activated based on the detection result from the thermistor 38 so as to adjust its output. As a result, the fixing belt 22 maintains the fixing temperature at a constant level. However, as described above, the thermostat 537 arranged in contact with the support roller 523 detects an event in that the surface temperature of the support roller 523 exceeds a predetermined temperature. When detecting such an excess temperature, the thermostat 537 shuts off the power to the induction heater 24. Thereby, the induction heater 24 is restricted to apply heat to the support roller 23.

Figure 26:
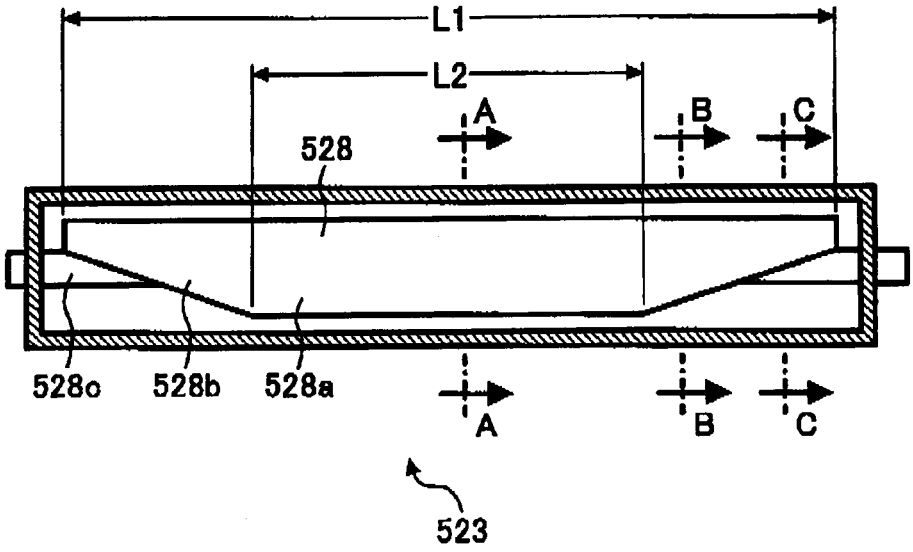
FIGS. 26 and 27 are illustrations for explaining a structure of another support roller.
Figure 27:
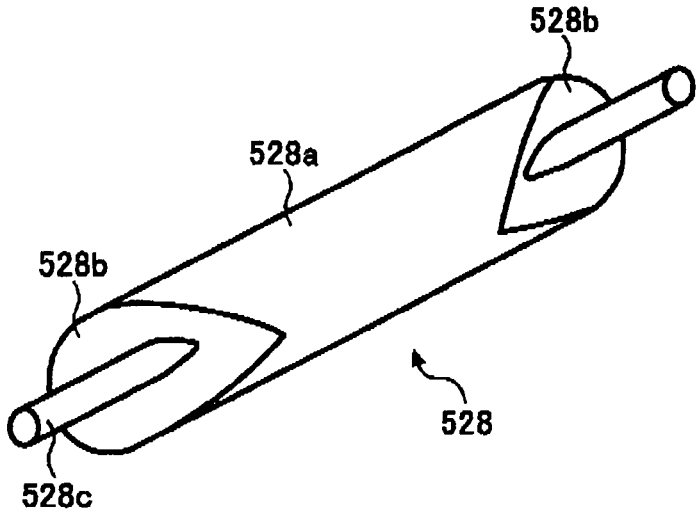

As illustrated in FIG. 26, the internal core 528 of the support roller 523 employed by the image fixing unit 520 has sides both canted off and includes a main body 528*a*, canted surfaces 528*b*, and a shaft 528*c*. The canted surfaces 528*b* of the internal core 528 are more clearly shown in FIG. 27. The thus-structured support roller 523 of FIG. 26 is similar to the support roller 23 of FIG. 3, except for these crosswise cuttings.

The internal core 528 structured in this way has in its width direction an outer circumferential surface length which faces the coil 25. This outer circumferential surface length of the internal core 528 facing the coil 528 is gradually increased or decreased by a rotary movement of the internal core 528 itself.

Since the internal core 528 is configured to be driven to rotate by an arbitrary angle in a manner similar to the internal core 28, it is possible to change the heating area M and the heat reduction area, as is performed by the support roller 23, by rotating the internal core 528 to cause the canted surfaces 528*c* to face the center core 26*a* with a desired angle.

Figure 28A:
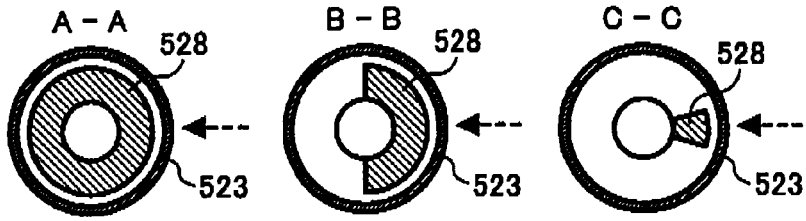
FIGS. 28A-28C are illustrations for explaining variations of an outer circumferential surface length of an internal core when the internal core is rotated by different angles.
Figure 28B:
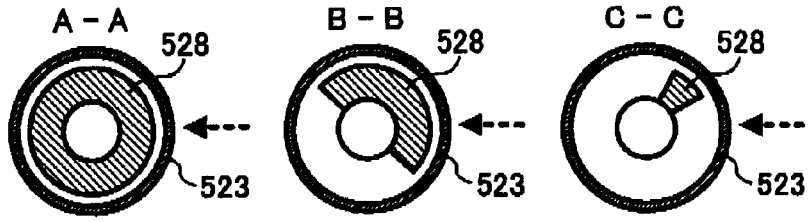
Figure 28C:
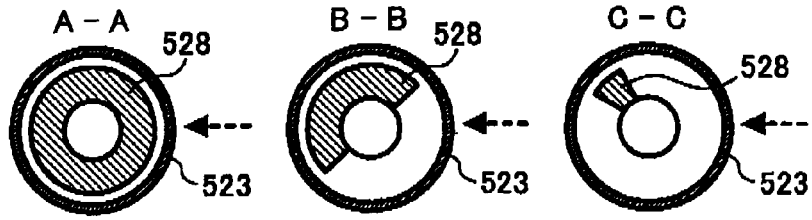

More specifically, seeing from one of the two canted surfaces 528*c*, an area of the canted surface 528*c* facing the center core 26*a* can be changed by a rotary movement of the internal core 528. Therefore, a change of the area of the canted surface 528*c* corresponds to a variation of the heating area M and the heat reduction area N shown in FIG. 6B, for example. That is, an amount of the magnetic flux generated between the core 26 and the internal core 528 is increased or decreased in accordance with the outer circumferential length of the internal core 528 facing the coil 25. When the outer circumferential surface length of the internal core 528 facing the coil 25 is relatively long, the heating area M is relatively long and the heat reduction area N is relatively short. Similarly, when the outer circumferential surface length of the internal core 528 facing the coil 25 is relatively long, the heating area M is relatively short and the heat reduction area N is relatively short. FIGS. 28A-28C show example conditions when the outer circumferential surface length of the internal core 528 facing the coil 25 is extended to its maximum length, a middle length, and its minimum length. In each of FIGS. 28A-28C, an arrow with a dotted line indicates a direction in which the magnetic flux is applied.

FIG. 28A shows a cross-sectional view of the support roller 523 seen in lines A-A, B-B, and C-C of FIG. 26, when the internal core 528 is rotated so that the outer circumferential surface length of the internal core 528 facing the coil 25 is extended to its maximum length, i.e., the width L1.

Similarly, FIG. 28B shows a cross-sectional view of the support roller 523 seen in lines A-A, B-B, and C-C of FIG. 26, when the internal core 528 is rotated so that the outer circumferential surface length of the internal core 528 facing the coil 25 is extended to a middle length between the width L1 and the width L2.

Similarly, FIG. 28C shows a cross-sectional view of the support roller 523 seen in lines A-A, B-B, and C-C of FIG. 26, when the internal core 528 is rotated so that the outer circumferential surface length of the internal core 528 facing the coil 25 is extended to its minimum length, i.e., the width L2.

In this way, the image fixing unit 520 of the image forming apparatus 1 is provided with the internal core 528 which has the canted surfaces 528*c*. Rotation of the canted surfaces 528*c* makes it possible to control the magnetic flux acting on the fixing belt 22 and the support roller 23 so as to change the heating area M and the heat reduction area N. Thereby, the image fixing unit 520 can suppress the temperature rises with reliability at the both sides of the fixing belt 22 and the support roller 23.

Figure 29:
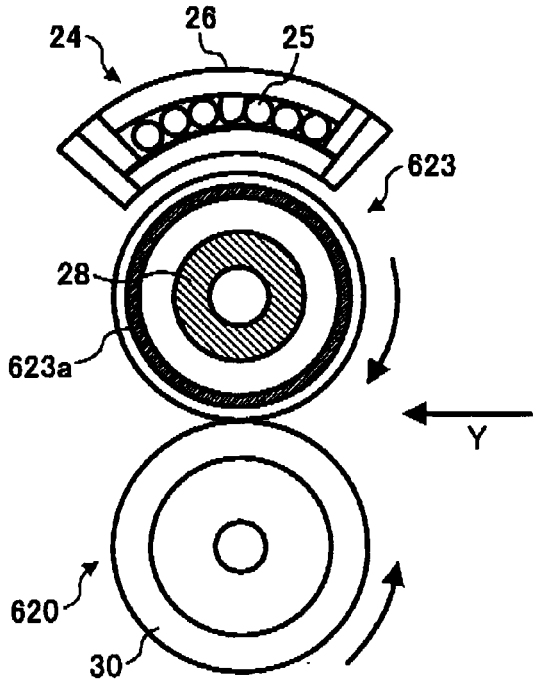
FIG. 29 is a schematic diagram of another image fixing unit of the image forming apparatus shown in FIG. 1.

Referring to FIG. 29, another example image fixing unit 620 is explained. FIG. 29 illustrates the image fixing unit 620 which has a structure similar to the image fixing unit 20 of FIG. 2, except for a support roller 623. As illustrated in FIG. 29, the support roller 523 includes a heat layer 523*a* and is arranged in contact directly with the pressure roller 30 to catch the recording sheet P transported in the direction Y. Therefore, in this structure, the image fixing unit 620 does not need the fixing belt. Such a support roller 623 may be referred to as a heat roller or a fixing roller.

In this structure, the image fixing unit 620 employs the internal core 528 of FIG. 26, which has the canted surfaces 528*c*. Therefore, rotation of the canted surfaces 528*c* makes it possible to control the magnetic flux acting on the fixing belt 22 and the support roller 23 so as to change the heating area M and the heat reduction area N, in a similar manner as is performed by the image fixing unit 520. Thereby, the image fixing unit 620 can suppress the temperature rises with reliability at the both sides of the support roller 623.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed is:

1. An image forming apparatus, comprising:

an image forming mechanism configured to form a toner image on a recording sheet; and an image fixing unit configured to fix the toner image onto the recording sheet, the unit comprising:

a magnetic flux generator configured to generate a magnetic flux;

a heat member configured to be heated inductively by the magnetic flux generated by the magnetic flux generator;

a magnetic flux adjuster having a lateral side edge with a plurality of steps and configured to reduce the magnetic flux active on the heat member to stepwise change a heat reduction area in a width direction of the heat member to reduce a heating area in a width direction of an outer circumferential surface of the heat member; and a controlling member configured to move the magnetic flux adjuster to cause one of the plurality of steps to be situated at a position to shield the magnetic flux, wherein the heat member includes a fixing member configured to melt the toner image, the fixing member includes a fixing belt, and the magnetic flux generator is arranged at a position to face the fixing belt.

2. The image forming apparatus according to claim 1, further comprising:

a sheet detector configured to detect a width of the recording sheet corresponding to a sheet-passing area in a width direction of the heat member, wherein the controlling member moves the magnetic flux adjuster in accordance with a detection result by the sheet detector to cause one of the plurality of steps corresponding to the width of the recording sheet to be situated at a position to shield the magnetic flux.

3. The image forming apparatus according to claim 2, wherein the sheet detector includes a sheet size detector configured to detect a sheet size of the recording sheet.

4. The image forming apparatus according to claim 1, further comprising:

an environment detector configured to detect an environment temperature, wherein the controlling member moves the magnetic flux adjuster in accordance with a detection result by the environment detector to cause one of the plurality of steps corresponding to a level of the environment temperature to be situated at a position to shield the magnetic flux.

5. The image forming apparatus according to claim 1, further comprising:

a sheet thickness detector configured to detect a thickness of the recording sheet, wherein the controlling member moves the magnetic flux adjuster in accordance with a detection result by the sheet thickness detector to cause one of the plurality of steps corresponding to a level of the thickness of the recording sheet to be situated at a position to shield the magnetic flux.

6. The image forming apparatus according to claim 1, further comprising:

a sheet kind detector configured to detect a kind of the recording sheet, wherein the controlling member moves the magnetic flux adjuster in accordance with a detection result by the sheet kind detector to cause one of the plurality of steps corresponding to a kind of the recording sheet to be situated at a position to shield the magnetic flux.

7. The image forming apparatus according to claim 1, further comprising:

a transfer speed detector configured to detect a transfer speed of the recording sheet, wherein the controlling member moves the magnetic flux adjuster in accordance with a detection result by the transfer speed detector to cause one of the plurality of steps corresponding to a transfer speed of the recording sheet to be situated at a position to shield the magnetic flux.

8. The image forming apparatus according to claim 1, further comprising:

an auxiliary roller, and a pressure roller, wherein the fixing belt is extended between the heat roller and the auxiliary fixing roller, and the auxiliary fixing roller is arranged at a position to receive a pressure from the pressure roller via the fixing belt.

9. The image forming apparatus according to claim 1, further comprising:

a pressure roller configured to apply a pressure to the recording sheet, wherein the fixing member includes a fixing roller configured to receive the pressure from the pressure roller via the recording sheet.

10. The image forming apparatus according to claim 1, wherein the controlling member is further configured to determine a rotational attitude of the magnetic flux generator to move the magnetic flux adjuster to change the heat reduction area.

11. An image forming apparatus comprising:

an image forming mechanism configured to form a toner image on a recording sheet; and an image fixing unit configured to fix the toner image onto the recording sheet, the unit including a magnetic flux generator configured to generate a magnetic flux, a heat member configured to be heated inductively by the magnetic flux generated by the magnetic flux generator, a magnetic flux adjuster having a lateral side edge with a plurality of steps and configured to reduce the magnetic flux active on the heat member to stepwise change a heat reduction area in a width direction of the heat member to reduce a heating area in a width direction of an outer circumferential surface of the heat member, and a controlling member configured to move the magnetic flux adjuster to cause one of the plurality of steps to be situated at a position to shield the magnetic flux, wherein the magnetic flux generator includes a coil configured to have a shape extended in the width direction and to face the heat member, and an internal core configured to face the coil via the heat member, and wherein the magnetic flux adjuster is arranged at a position between the coil and the internal core.

12. The image forming apparatus according to claim 11, wherein the magnetic flux adjuster is configured to change continuously or stepwise the heat reduction area which covers an outer circumferential surface of the internal core facing the coil.

13. The image forming apparatus according to claim 12, wherein the controlling member is configured to move the magnetic flux adjuster to change continuously or stepwise the heat reduction area.

14. The image forming apparatus according to claim 11, wherein the magnetic flux generator further comprises:

a core configured to face the coil from a side of the coil opposite from another side of the coil facing the internal core and to have a center core around a middle of an inside surface of the core facing the coil, and wherein the magnetic flux adjuster is further configured to cover a part of an outer circumferential surface of the internal core facing the center core.

15. The image forming apparatus according to claim 14, further comprising:

a fixing member configured to melt the toner image, wherein the heat member is further configured to heat the fixing member.

16. The image forming apparatus according to claim 15, further comprising:

an auxiliary fixing roller, and wherein the heat member includes a heat roller and the fixing member includes a fixing belt, wherein the fixing belt is extended between the heat roller and the auxiliary fixing roller, and wherein the magnetic flux generator is arranged at a position to face the fixing belt.

17. The image forming apparatus according to claim 16, further comprising:

a pressure roller, wherein the auxiliary fixing roller is arranged at a position to receive a pressure from the pressure roller via the fixing belt.

18. A method of operating an image forming apparatus, comprising:

generating a magnetic flux using a magnetic flux generator;

inductively heating a heat member by the magnetic flux generated by the magnetic flux generator;

reducing the magnetic flux active on the heat member using a magnetic flux adjuster having a lateral side edge with a plurality of steps to stepwise change a heat reduction area in a width direction of the heat member to reduce the heating area in a width direction of an outer circumferential surface of the heat member; and moving the magnetic flux adjuster to cause one of the plurality of steps to be situated at a position to shield the magnetic flux, wherein the magnetic flux generator includes a coil configured to have a shape extended in the width direction and to face the heat member, and an internal core configured to face the coil via the heat member, and wherein the magnetic flux adjuster is arranged at a position between the coil and the internal core.

19. The method according to claim 9, further comprising:

detecting a width of the recording sheet corresponding to a sheet-passing area in a width direction of the heat member; and moving the magnetic flux adjuster in accordance with a detection result by the detecting to cause one of the plurality of steps corresponding to the width of the recording sheet to be situated at a position to shield the magnetic flux.

20. The method according to claim 9, further comprising:

detecting an environment temperature; and moving the magnetic flux adjuster in accordance with a detection result by the detecting to cause one of the plurality of steps corresponding to a level of the environment temperature to be situated at a position to shield the magnetic flux.

21. An image forming apparatus, comprising:

an image forming mechanism configured to form a toner image on a recording sheet;

an image fixing unit configured to fix the toner image onto the recording sheet, the unit including a magnetic flux generator configured to generate a magnetic flux, a heat member configured to be heated inductively by the magnetic flux generated by the magnetic flux generator, a non-magnetic shield metal configured to reduce the magnetic flux active on the heat member to form a heat reduction area at both ends in a width direction of the heat member, and a controller configured to rotate the non-magnetic shield metal based on a temperature to change the heat reduction area during a consecutive image forming job on a plurality of recording sheets of a same size; and a temperature detector configured to detect a temperature of the heat member, wherein the controller rotates the non-magnetic shield metal so as to shorten a width of the heat reduction area when the temperature detected by the temperature detector is equal to or smaller than a predetermined value.

22. The image forming apparatus according to claim 21, wherein the controller is further configured to rotate the non-magnetic shield metal so as to change the heat reduction area based on a temperature and a sheet size.

23. The image forming apparatus according to claim 21, wherein the non-magnetic shield metal includes copper.

24. The image forming apparatus according to claim 21, wherein the controller is further configured to rotate the non-magnetic shield metal so that the heat reduction area becomes wider than a non-sheet-passing area of the recording sheets.

25. An image forming apparatus comprising:

an image forming mechanism configured to form a toner image on a recording sheet;

an image fixing unit configured to fix the toner image onto the recording sheet, the unit including a magnetic flux generator configured to generate a magnetic flux, a heat member configured to be heated inductively by the magnetic flux generated by the magnetic flux generator, a non-magnetic shield metal configured to reduce the magnetic flux active on the heat member to form a heat reduction area at both ends in a width direction of the heat member, and a controller configured to rotate the non-magnetic shield metal based on a temperature to change the heat reduction area during a consecutive image forming job on a plurality of recording sheets of a same size; and a temperature detector configured to detect a temperature of the heat member, wherein the controller rotates the non-magnetic shield metal so as to lengthen a width of the heat reduction area when the temperature detected by the temperature detector is equal to or greater than a predetermined value.

26. The image forming apparatus according to claim 25, wherein the controller is further configured to rotate the non-magnetic shield metal so as to change the heat reduction area based on a temperature and a sheet size.

27. The image forming apparatus according to claim 25, wherein the non-magnetic shield metal includes copper.

28. The image forming apparatus according to claim 25, wherein the controller is further configured to rotate the non-magnetic shield metal so that the heat reduction area becomes wider than a non-sheet-passing area of the recording sheets.

* * * * *

UNITED STATES PATENT AND TRADEMARK OFFICE

CERTIFICATE OF CORRECTION

PATENT NO. : 8,422,901 B2
APPLICATION NO. : 13/026945
DATED : April 16, 2013
INVENTOR(S) : Kenji Ishii et al.

It is certified that error appears in the above-identified patent and that said Letters Patent is hereby corrected as shown below:

On the title page, Item (75), Aldyasu, Amita should read:

--(75) Inventors: Akiyasu Amita, Yokohama (JP);--

Signed and Sealed this
Fourth Day of June, 2013

Teresa Stanek Rea

Teresa Stanek Rea
*Acting Director of the United States Patent and Trademark Office*